US007293521B1

(12) United States Patent
Johns, Jr. et al.

(10) Patent No.: US 7,293,521 B1
(45) Date of Patent: Nov. 13, 2007

(54) HYDRAULIC TRANSOM LIFT

(75) Inventors: Carl E. Johns, Jr., Cocoa, FL (US); Stephen Johns, Merritt Island, FL (US)

(73) Assignee: Sealift, Inc., Cocoa, FL (US)

( * ) Notice: Subject to any disclaimer, the term of this patent is extended or adjusted under 35 U.S.C. 154(b) by 15 days.

(21) Appl. No.: 11/090,827

(22) Filed: May 10, 2005

(51) Int. Cl.
*B63B 35/40* (2006.01)
*B63B 23/10* (2006.01)
*B63C 3/06* (2006.01)

(52) U.S. Cl. ..... 114/259; 114/369; 114/371; 405/3

(58) Field of Classification Search ..... 114/259, 114/365, 368, 369, 373, 370, 371, 191–195; 405/3

See application file for complete search history.

(56) References Cited

U.S. PATENT DOCUMENTS

| | | | | |
|---|---|---|---|---|
| 582,069 | A | 5/1897 | Leslie | |
| 2,185,083 | A | 12/1939 | Horton | 9/22 |
| 2,761,571 | A * | 9/1956 | Adams | 414/137.7 |
| 3,021,965 | A * | 2/1962 | Harvey | 414/678 |
| 3,244,300 | A | 4/1966 | Erdody | 214/85 |
| 5,133,275 | A * | 7/1992 | Maurizio | 114/259 |
| 5,184,913 | A * | 2/1993 | Meriwether | 405/1 |
| 5,544,606 | A | 8/1996 | Schmidt, Jr. | 114/48 |
| 5,664,516 | A | 9/1997 | Breeden | 114/259 |
| 5,669,324 | A * | 9/1997 | Muir, III | 114/194 |
| 6,003,463 | A | 12/1999 | Giesler | 114/259 |
| 6,327,992 | B1 | 12/2001 | Martin | 114/259 |
| 6,474,256 | B1 | 11/2002 | Vogel | 114/368 |
| 6,598,549 | B1 * | 7/2003 | Voegeli | 114/44 |
| 6,782,842 | B1 | 8/2004 | Alvord | 114/369 |
| 6,786,170 | B2 | 9/2004 | Trowbridge | 114/259 |

FOREIGN PATENT DOCUMENTS

WO WO 2004/022421 * 3/2004

* cited by examiner

*Primary Examiner*—Sherman Basinger
(74) *Attorney, Agent, or Firm*—Brian S. Steinberger; Law Offices of Brian S. Steinberger, P.A.

(57) ABSTRACT

Devices, apparatus and systems for raising and lowering watercraft such as personal watercraft, jet skis, inflatables from transoms on boats, from bulkheads and from docks, and for raising and lowering other types of vessels. A single actuator such as a fluid operated cylinder and single piston can raise and lower a cradle that supports the personal watercraft. An crank bracket can be fixably attached to a crank shaft, and an arm which supports the cradle can be fixably attached to the crank shaft. The arm can be extendable to different lengths. The cradle can include a self-leveling carriage that uses rollers to roll on a curved surface of the cradle allowing the supported watercraft to remain in a substantially level position thereon. An adjustable swivel mount can also be used to lock the cradle to the arm in a fixed orientation.

21 Claims, 19 Drawing Sheets

FIG.12 A/B/C

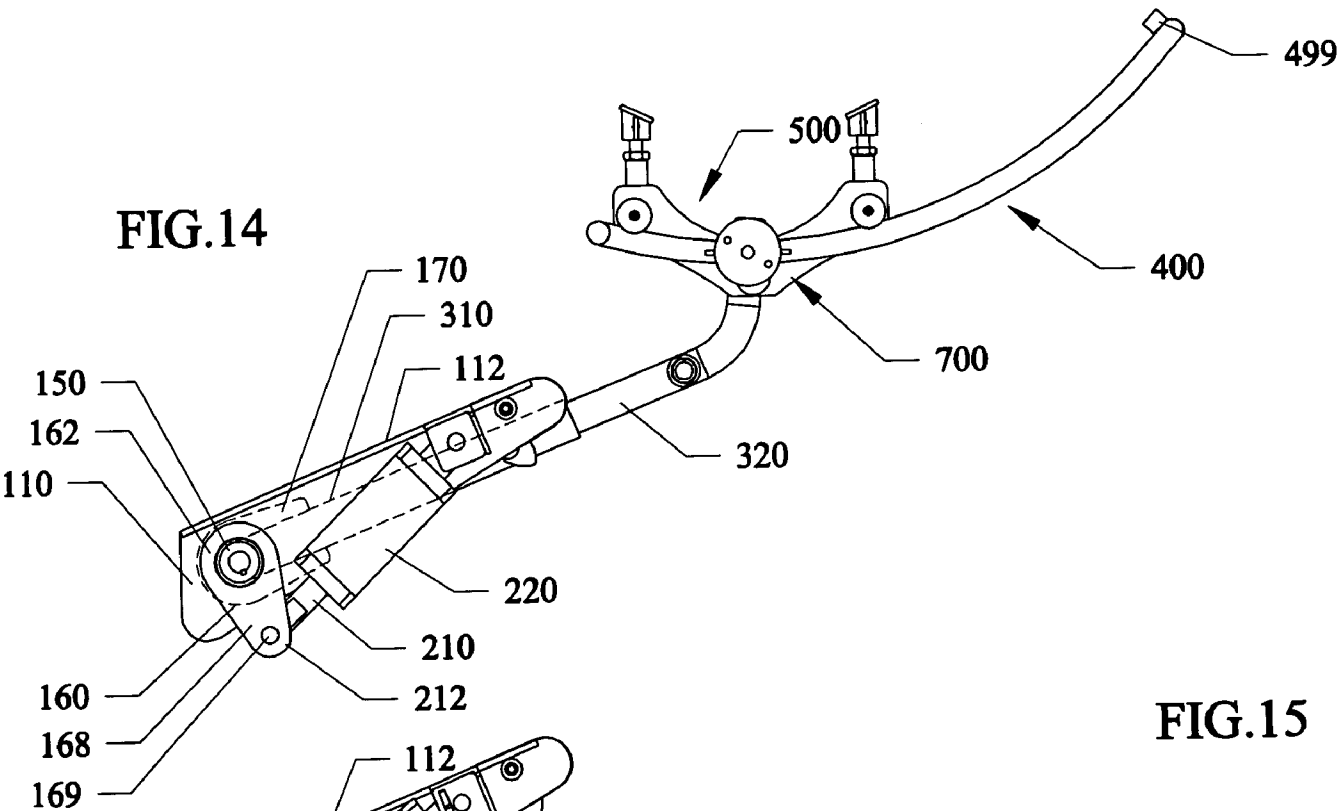
FIG.14
FIG.15
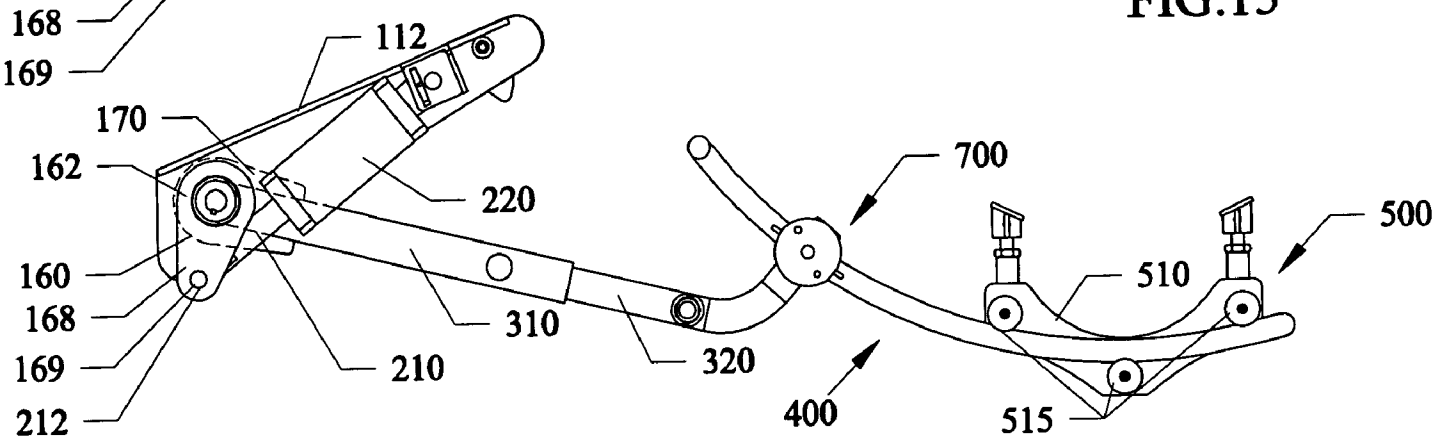

FIG.24
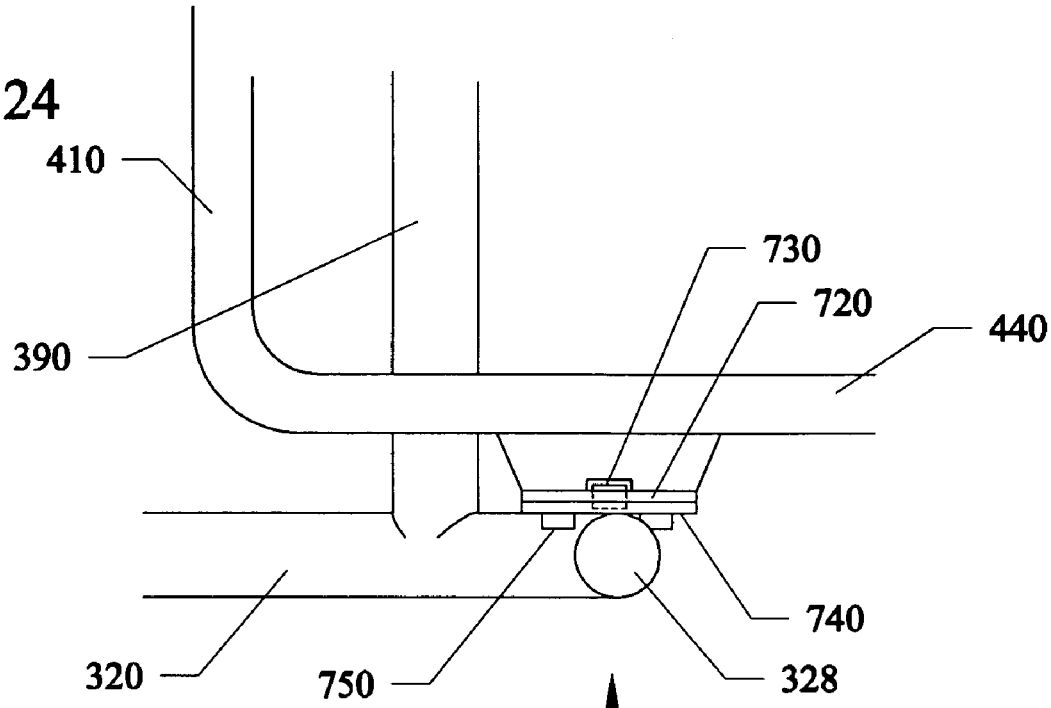
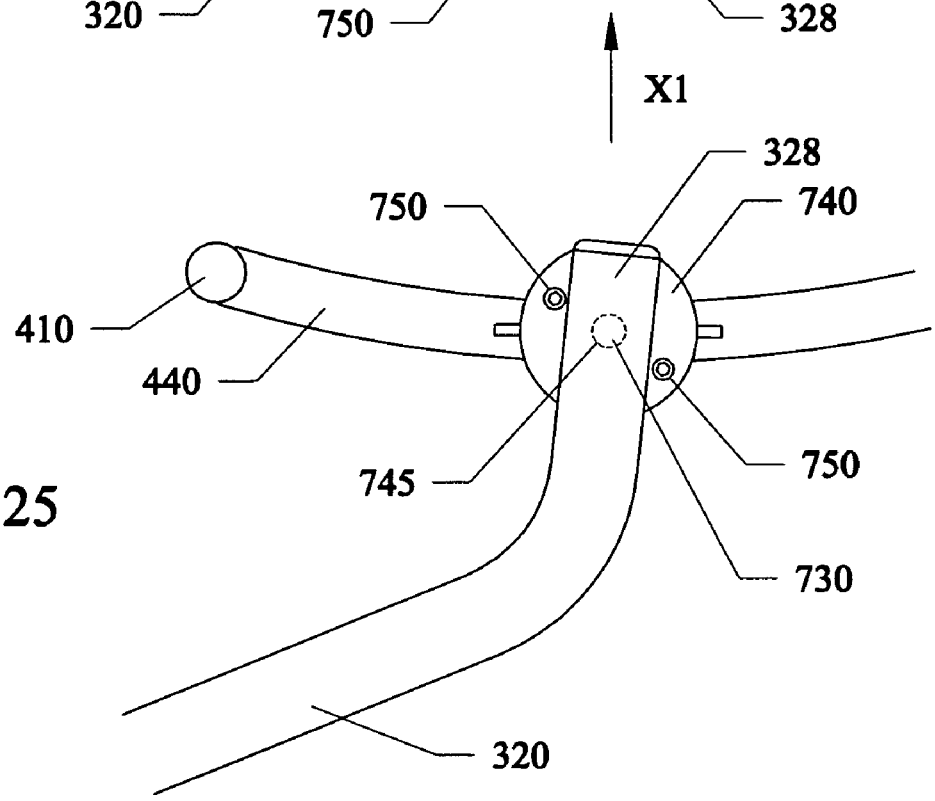
FIG.25

HYDRAULIC TRANSOM LIFT

This invention relates to watercrafts and in particular to devices, apparatus and systems for raising and lowering watercrafts such as jet skis, inflatables, rowboats, small personal watercrafts, and the like, as well as other types of vessels from swim platforms on the back of larger pleasure crafts, from docks, from bulkheads, and the like.

BACKGROUND AND PRIOR ART

Small craft lift devices for raising and lowering small craft type boats into and out of the water which can be mounted off larger boats have been used over the years. However, the known devices have limitations and problems that effect their applications in the real world.

Old versions of the small craft lift devices have used pulleys, and block and tackle arrangements with lines to raise and lower a fixed cradle or platform. However, the lines and pulleys and blocks and tackle required can easily become tangled, and difficult to operate. Also, these old type devices generally require hand operated cranks that are not desirable nor efficient or practical for the person operating these lift devices. Still furthermore, the fixed platforms and cradles used are also problematic since many include surfaces which may scratch, mar and damage the hulls and bottoms of the small type boats. See for example, U.S. Pat. No. 582,069 to Leslie and U.S. Pat. No. 2,185,083 to Horton.

Many current type small craft boat lifts require complex and expensive arrangements of plural hydraulic type cylinders to raise and lower a platform or fixed cradle. These lifts often locate the small crafts at a distance from the main boat. The fixed platforms and cradles used are also problematic since many include surfaces which may scratch, mar and damage the hulls and bottoms of the small type boats. See for example, U.S. Pat. No. 5,544,606 to Schmidt, Jr.; U.S. Pat. No. 6,003,463 to Giesler; U.S. Pat. No. 6,327,992 to Martin; U.S. Pat. No. 6,474,256 to Vogel; U.S. Pat. No. 6,782,842 to Alvord; and U.S. Pat. No. 6,786,170 to Trowbridge Thus, the need exists for solutions to the above problems with the prior art.

SUMMARY OF THE INVENTION

A primary objective of the present invention is to provide a practical, efficient, simple and easy to operate lift device, apparatus and system for raising and lowering watercrafts such as jet skis, inflatables, rowboats, personal watercrafts, and the like, and other vessels from swim platforms on the back of larger pleasure crafts, and the like.

A secondary objective of the present invention is to provide a practical, efficient, simple and easy to operate lift device, apparatus and system for raising and lowering watercrafts such as jet skis, inflatables, rowboats, personal watercrafts, and the like, and other vessels from docks, and the like.

A third objective of the present invention is to provide a practical, efficient, simple and easy to operate lift device, apparatus and system for raising and lowering watercrafts such as jet skis, inflatables, rowboats, personal watercrafts, and the like, and other vessels from swim platforms off pleasure crafts, from bulkheads, and the like.

A fourth objective of the present invention is to provide a practical, efficient, simple and easy to operate lift device, apparatus and system for raising and lowering watercrafts such as jet skis, inflatables, rowboats, personal watercrafts, and the like, and other vessels that only needs one actuator having a single fluid cylinder and single fluid operated piston.

A fifth objective of the present invention is to provide a practical, efficient, simple and easy to operate lift device, apparatus and system for raising and lowering watercrafts such as jet skis, inflatables, rowboats, personal watercrafts, and the like, and other vessels that does not scratch, mar or damage the underside of the watercrafts being raised and lowered.

The sixth objective of the present invention is to provide a practical, efficient, simple and easy to operate lift device, apparatus and system for raising and lowering watercrafts from support structures such as boat transoms, bulkheads and docks, where the watercrafts are raised and lowered in close proximity to the support structures.

A lifting device for raising and lowering water crafts can include a frame attached to a support, a rotatable crank attached to the frame, a fluid operated actuator having one end attached to the frame and an another end attached to the crank member, an arm having a first end attached to the crank member and a second end, and a cradle supporting a watercraft which is attached to the second end of the arm, wherein the fluid actuator lowers and raises the cradle with the supported watercraft.

The rotatable crank can include a rotatable crank shaft with a crank blanket fixably attached to the rotatable crank shaft, the one end of the fluid operated actuator pivotably attached to the crank bracket and the first end of the arm fixably attached to the rotatable crank shaft.

The arm supporting the cradle can include a telescoping section that allows the arm to have a varying length.

The actuator can be a single hydraulic cylinder and single actuated piston for raising and lowering the arm and the attached cradle.

The cradle can have a concave curved surface on the cradle, and a self leveling carriage positioned on the concave curved surface of the cradle, the carriage allowing the watercraft to remain in a substantial level position while the arm and the attached cradle are being raised and lowered.

The cradle can have rollers between portions of the carriage and the cradle for allowing the carriage to roll relative to the cradle while the arm and the attached cradle are being raised and lowered. The rollers can include a first set of three rollers arranged in a triangular pattern on one side of the carriage, and a second set of three rollers arranged in a triangular pattern on another side of the carriage, the first and second sets of rollers allowing the carriage to roll relative to the cradle.

The carriage can also include upright supports pivotally attached to the carriage, the pivotal upright supports allowing the water craft to be firmly supported in a stable position to the carriage.

A swivel mount can be used for locking the cradle to the arm. The swivel mount can include a swivel plate having a fastener for holding the arm in a selected fixed orientation position relative to the cradle. The fastener can include a first fastener along one side of the arm, and a second fastener along another side of the arm, wherein the first and the second fasteners lock the cradle in the selected fixed orientation position relative to the cradle.

An extra securing latch can be used for holding the arm in the raised position, and the latch can use another fluid operated actuator for opening and closing the latch.

The lift can be attached to an angled surface such as a bottom transom, such as a swim platform on a large watercraft. The lift can also be attached underneath a horizontal surface such as a dock. The lift can also be mounted on wall type surfaces such as along a bulkhead.

In another version, the novel lift can attach underneath a swim platform on the back of a pleasure boat for raising and lowering a personal watercraft such as a jet ski, inflatable, and the like. The lift can have a lift arm with one end in a fixed perpendicular connection to one end of a crank arm. The second end of the lift arm is fixed to a cradle having a carriage supported thereon by a rollers. A perpendicular connection point between the crank arm and the lift arm can be pivotally connected to a mount that is attached underneath the swim platform. A single hydraulic cylinder has a piston that moves a second end of the crank arm from a first position to a second position. In the first position, the lift arm is raised, and in the second position, the lift arm is lowered and the cradle is in a lowered position. While the cradle moves from an up position to a lowered position, the supported personal watercraft being held by the carriage rolls off the cradle and into the water.

Further objects and advantages of this invention will be apparent from the following detailed description of the present preferred embodiments which are illustrated schematically in the accompanying drawings.

BRIEF DESCRIPTION OF THE FIGURES

FIG. 14 is a side partial cut-away view of the lift showing the fluid actuator holding the arm and cradle in a raised position.

FIG. 15 is another side partial cut-away view of the lift of FIG. 14 with arm and cradle in lowered position.

FIG. 24 is a top view of the swivel plate, mount, cradle and arm of FIG. 23.

FIG. 25 is a side view of the swivel plate, mount, cradle, arm of FIG. 24 along arrow X1.

DESCRIPTION OF THE PREFERRED EMBODIMENTS

Figure 1:
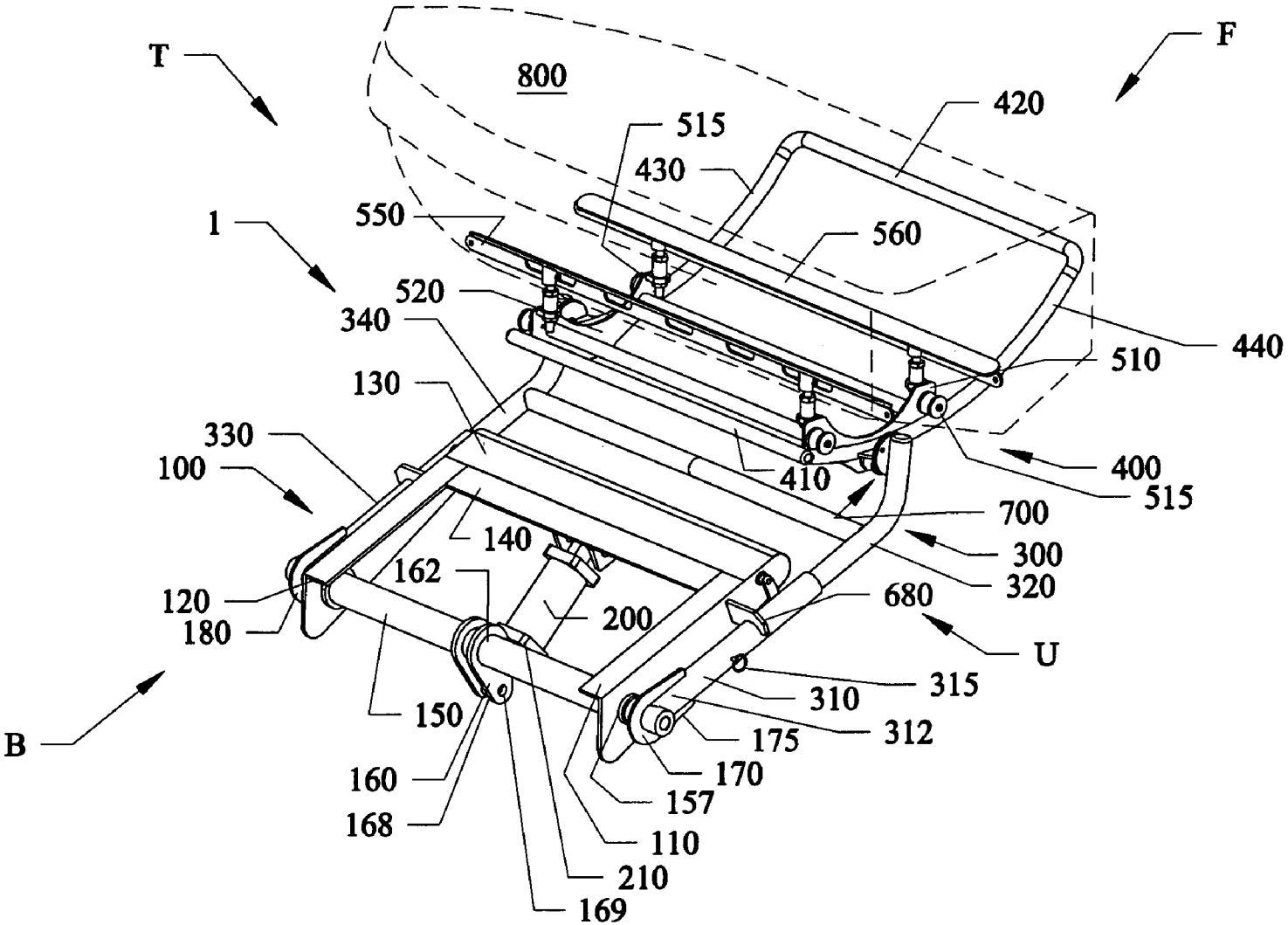
FIG. 1 is a back perspective view of the lift in an up position

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation. A list of components will now be listed.

1 lift device
100 frame assembly
110 Left bearing plate
112 flat portion left plate
120 Right bearing plate
122 flat portion right plate
130 Nose Shield
140 L-Shaped Cross Beam
150 Crank Shaft
151 Bearings
159 Bearings
160 Oblong Shaped Crank Bracket for actuator
162 Enlarged end
168 Narrow end
169 Pivot point
170 Left Arm Crank Socket
175 U-shaped Gosset
180 Right Arm Crank Socket
185 U-shaped Gosset
200 Single main actuator with single cylinder and single piston
210 Piston
212 Pivot end
220 Cylinder
222 Rearwardly protruding end
230 Parallel plates
300 lift arm assembly
310 left lift arm
315 Removable Cotter Pin
320 left extension member
328 End of left member
330 right lift arm
335 Removable Cotter Pin
340 right extension member
348 End of right member
400 Cradle
410 First End Beam
420 Second End Beam
430 First concave curved side beam
440 Second Concave curved side beam
500 Carriage
510 Left Arc Curved bracket

Figure 2:
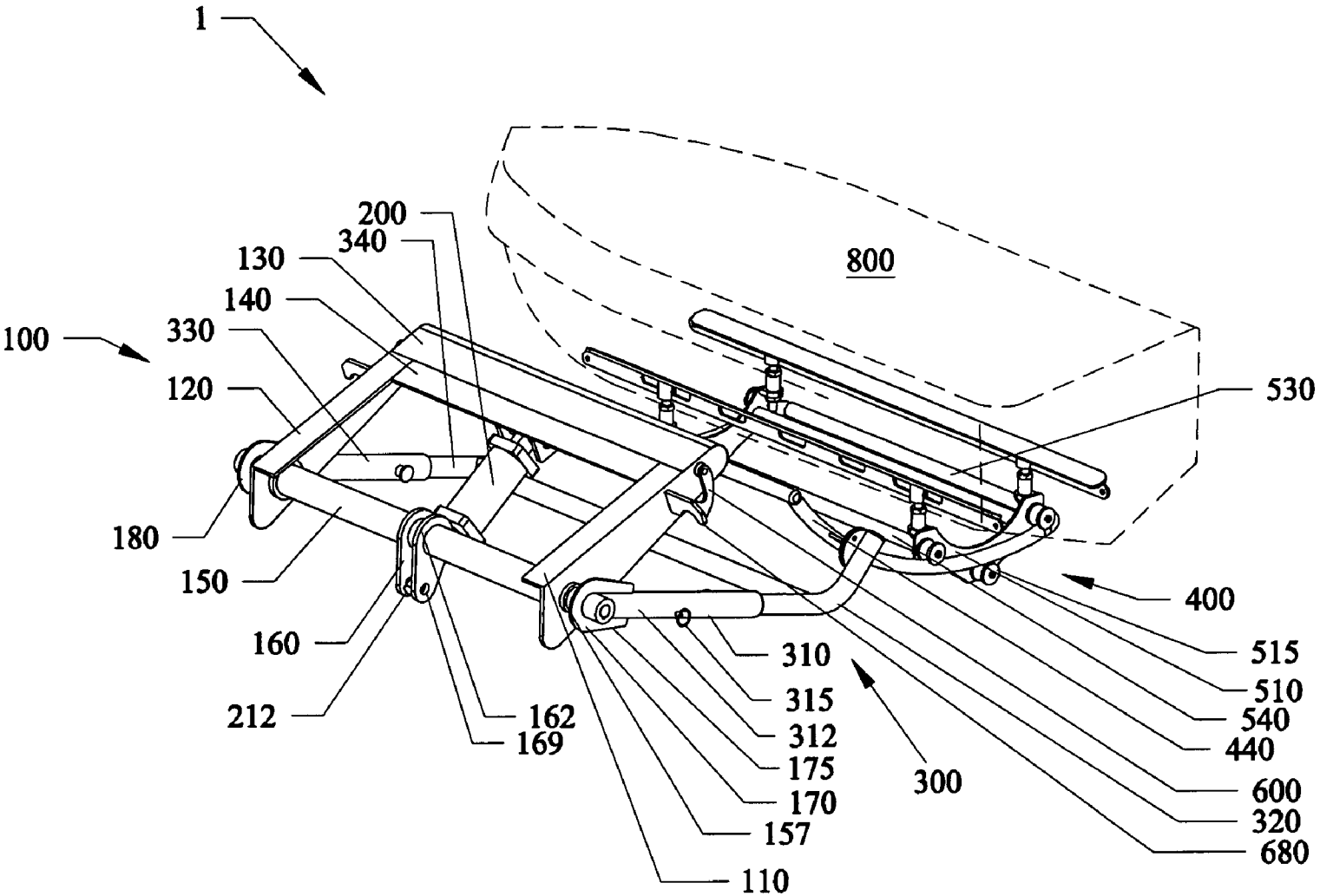
FIG. 2 is a back perspective view of the lift of FIG. 1 in a down position.
Figure 3:
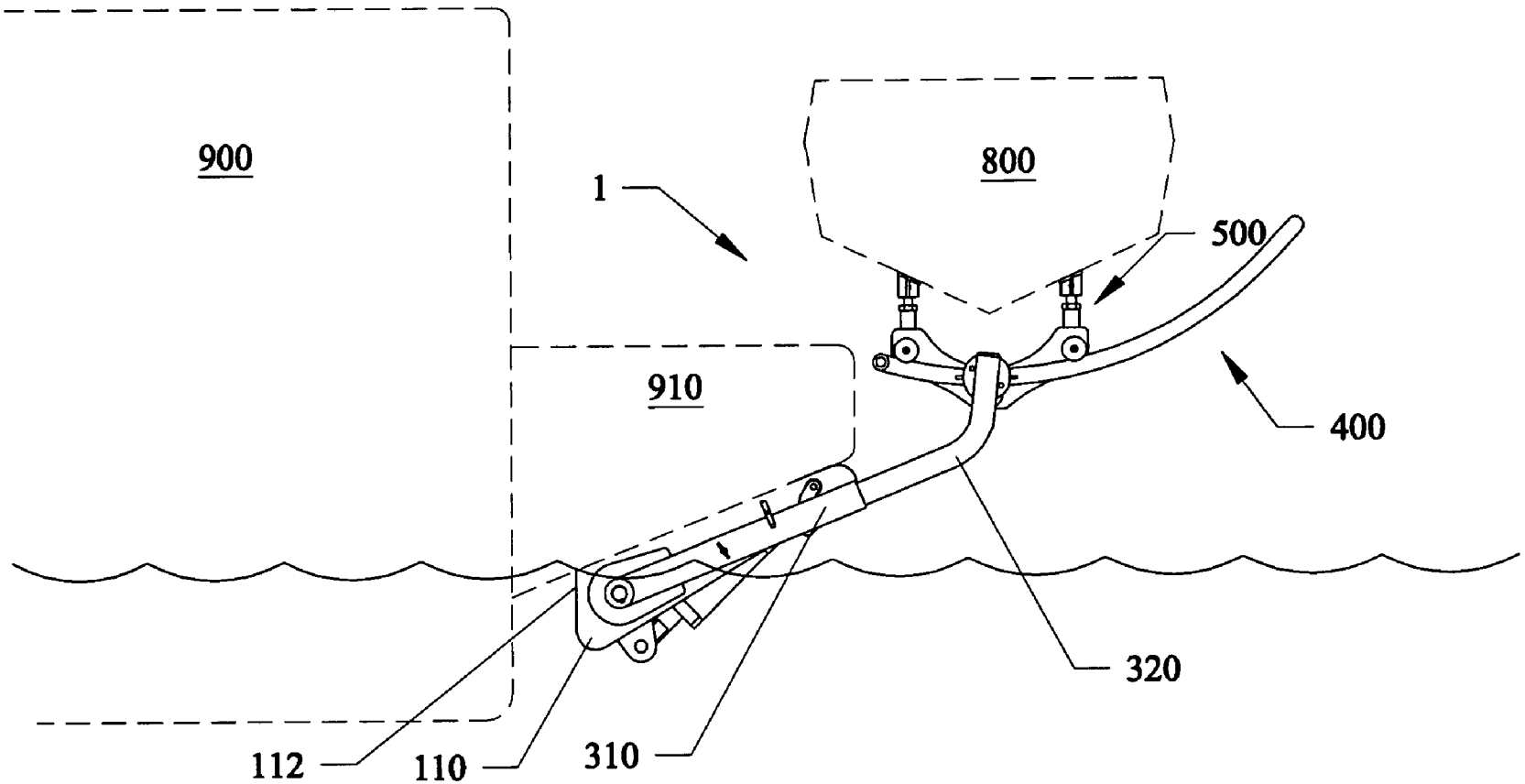
FIG. 3 is a side view of the lift of the preceding figures in an up position attached to a transom (swim platform) on a larger boat.
Figure 4:
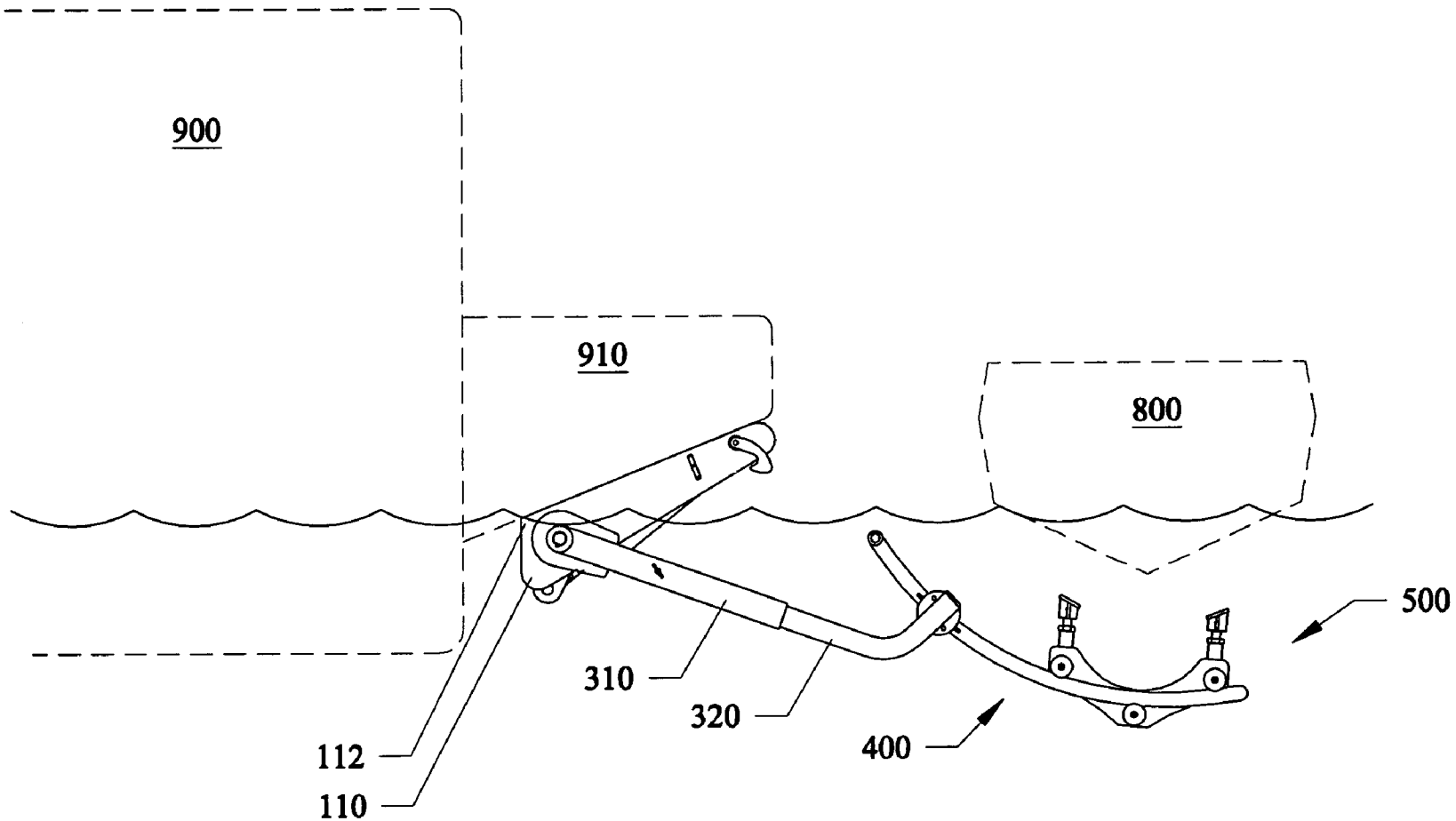
FIG. 4 is a side view of the lift of FIG. 3 in a down position.
Figure 5:
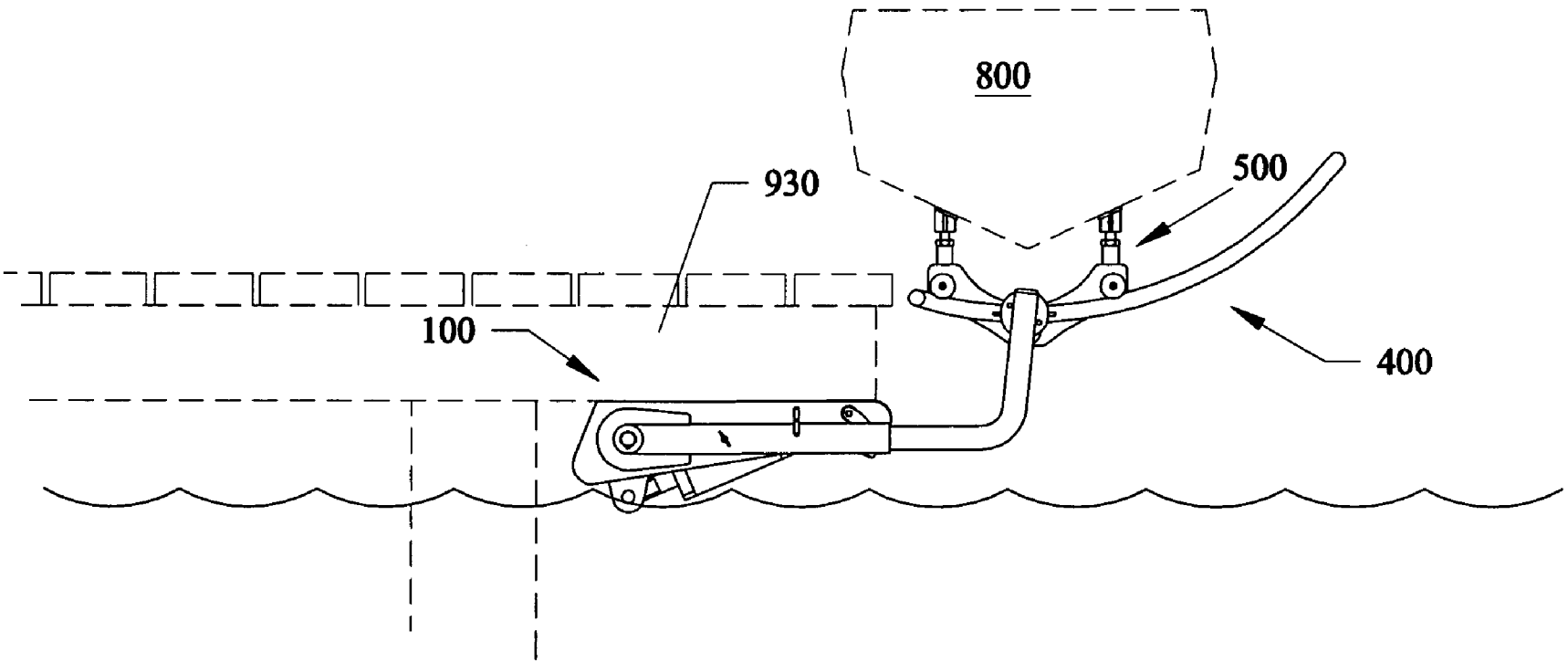
FIG. 5 is a side view of the lift in an up position attached to a dock.
Figure 6:
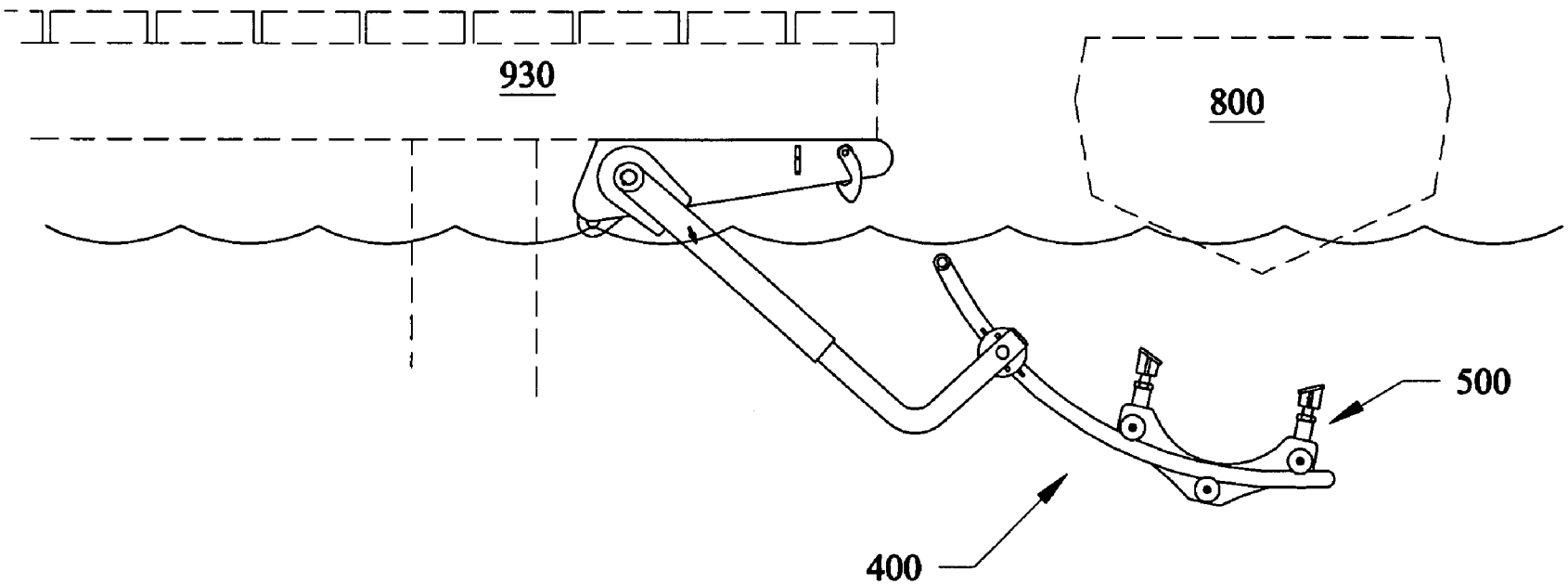
FIG. 6 is a side view of the lift of FIG. 5 in a down position.
Figure 7:
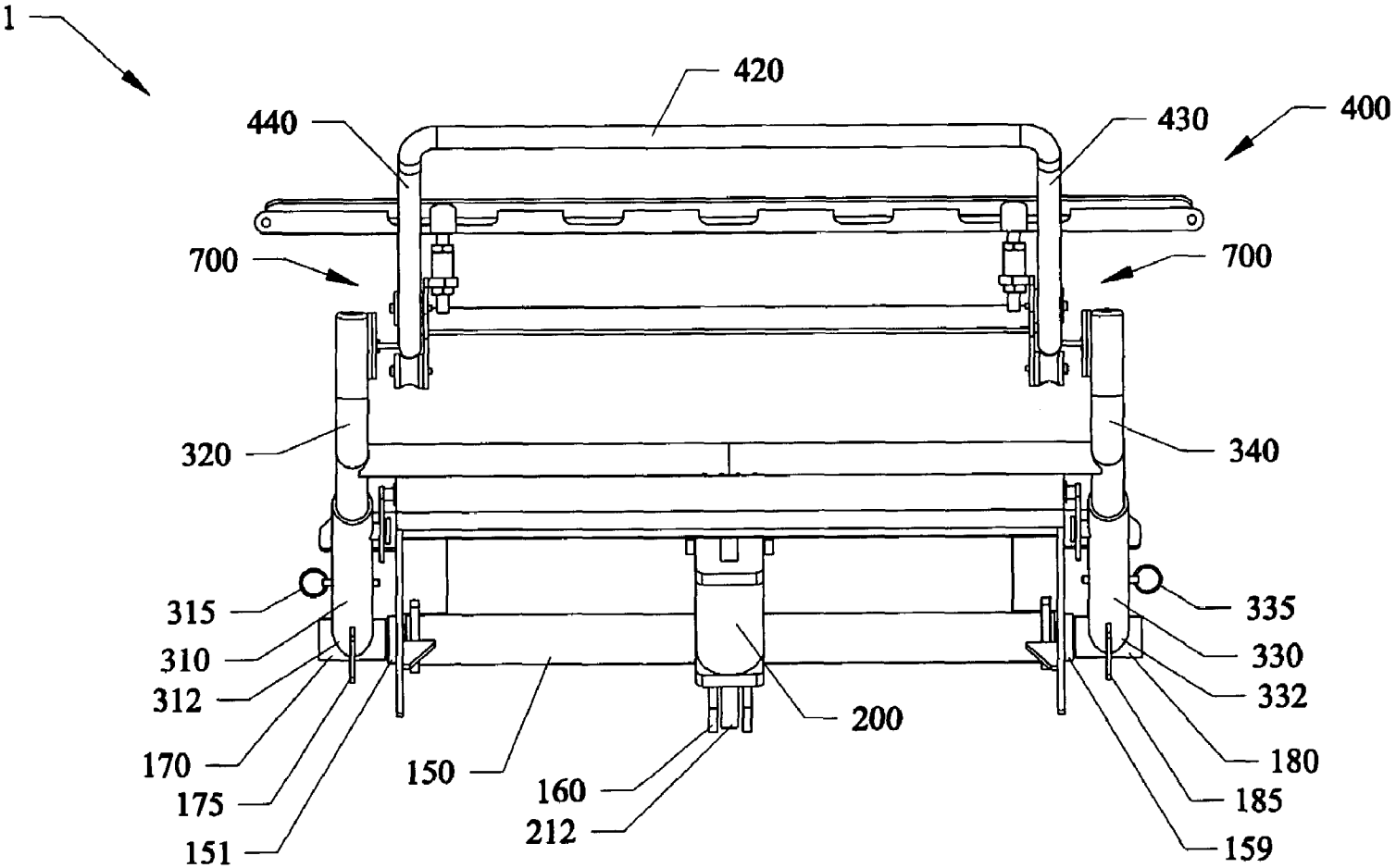
FIG. 7 is a front view of the lift of FIG. 1 along arrow F.
Figure 8:
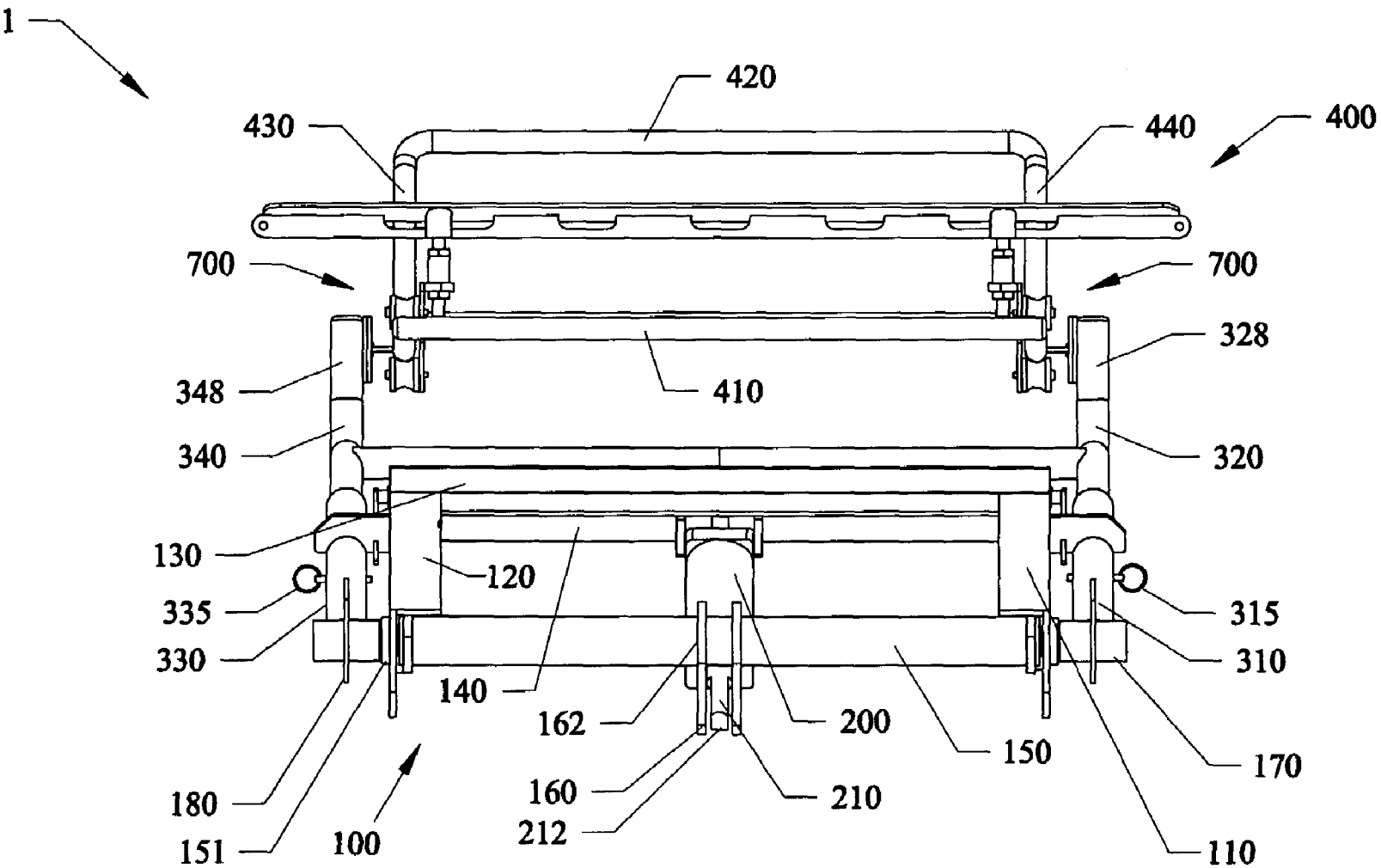
FIG. 8 is a back view of the lift of FIG. 1 along arrow B.
Figure 9:
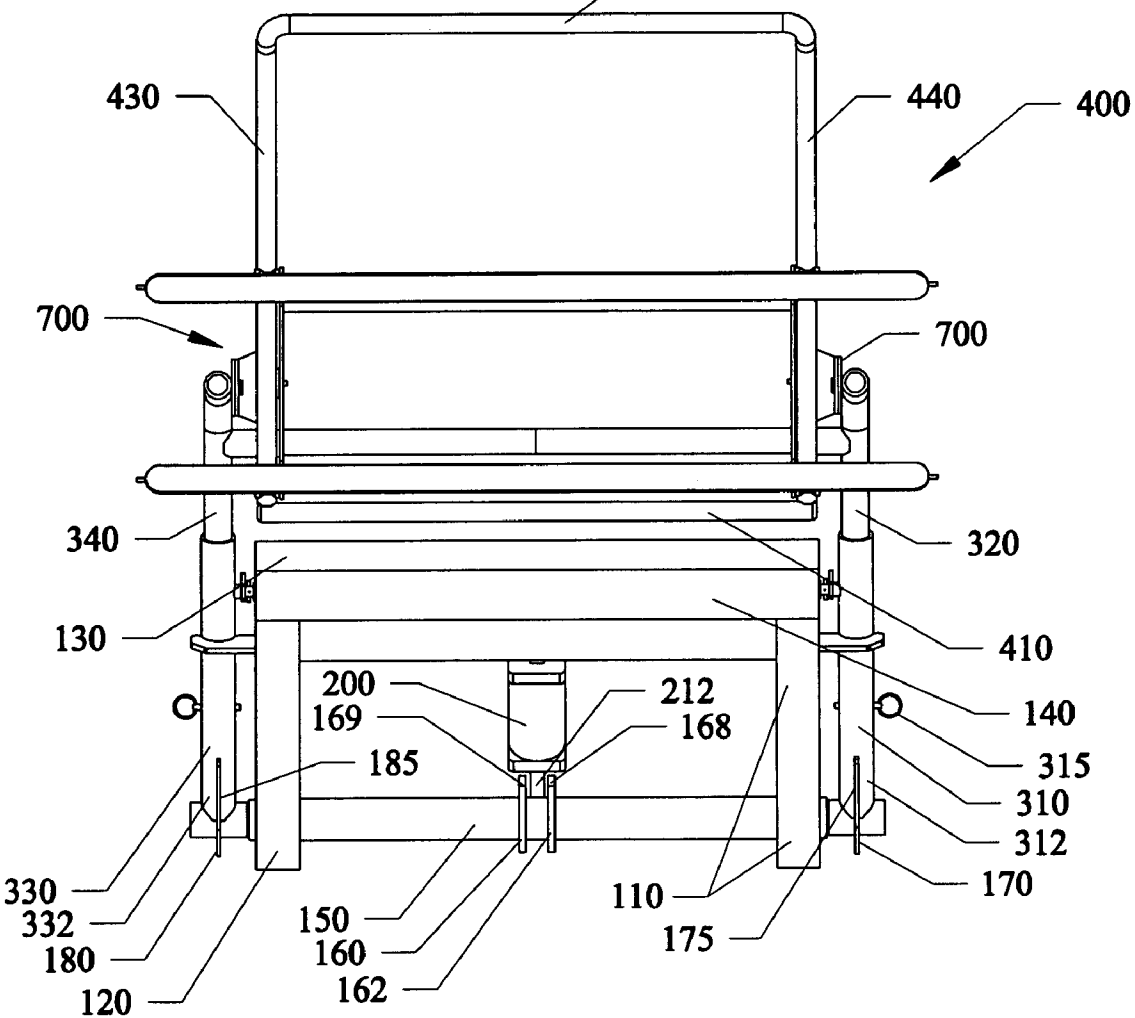
FIG. 9 is a top view of the lift of FIG. 1 along arrow T.
Figure 10:
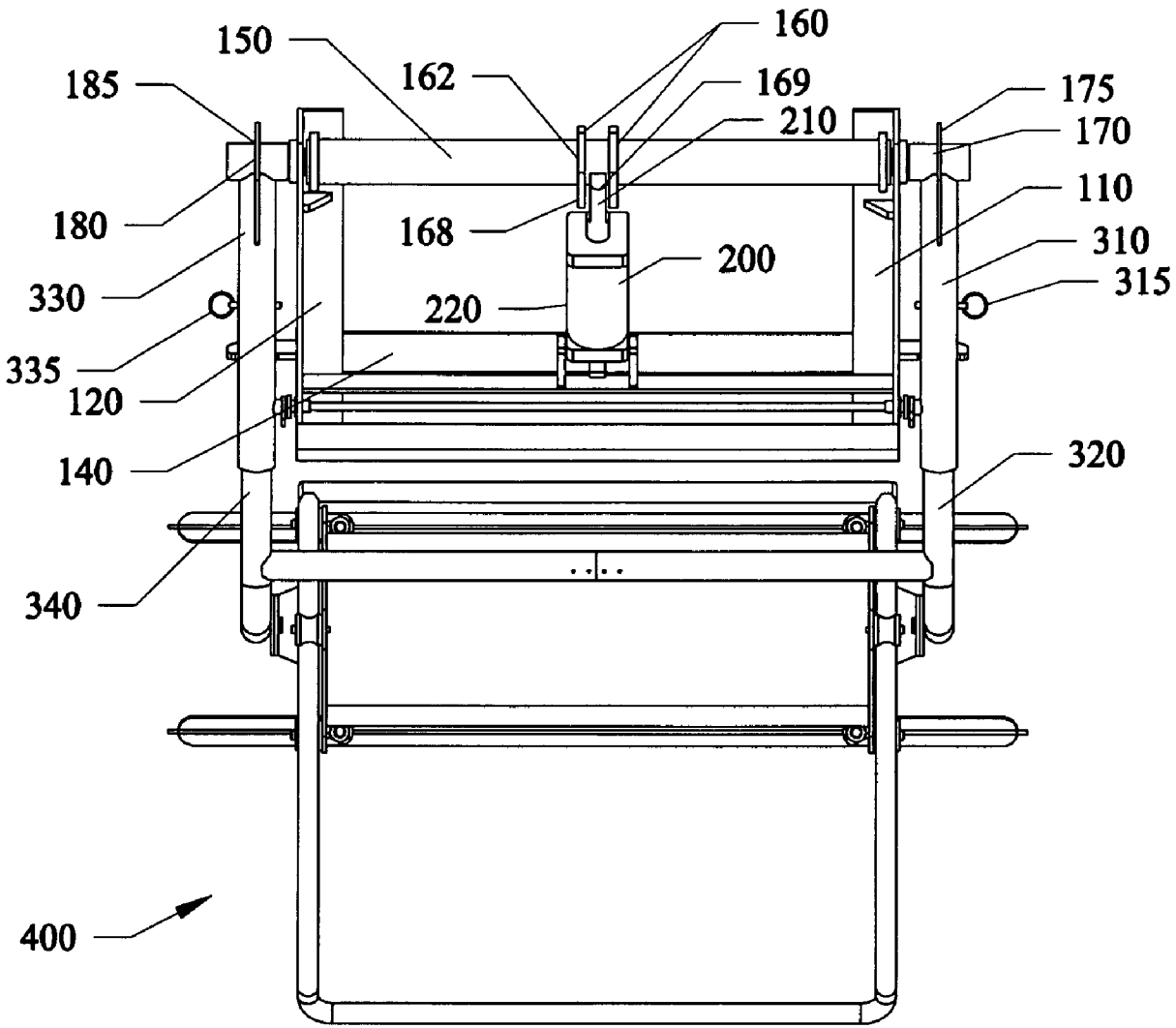
FIG. 10 is a bottom view of the lift of FIG. 1 along arrow U.

515 Left Triangular group of three rollers
520 Right Arc Curved bracket
525 Right Triangular group of three rollers
530 First Cross brace
540 Second Cross brace
550 First Craft support rail
555 Upper protective surface of rail
560 Second Craft support rail
565 Upper protective surface of rail
570 Upright riser
572 Bottom end of riser
574 Mid cylinder portion of riser
575 Tightening nut
578 Upper protruding portion
579 Pivot pin
600 Latch assembly
610 support bracket
612 side protrusion portion
615 pivot connection
620 latch fluid actuated cylinder
630 piston
640 latch lever
650 latch spring
660 upper latch member
665 latch pivot pin
670 lower latch member hook
680 lift stopper
690 latch pin
700 Swivel Mount assembly
710 mount on side beam of cradle
720 Side plate on for mount
730 Outwardly protruding cradle pivot pin
740 lift arm pivot plate
745 center hole in pivot plate
750 pivot plate mounting bolts
800 Personal Watercraft
900 Large Watercraft
910 Boat Transom
930 Dock
940 Bulkhead
950 Wall
960 Adapter FIG. 1 is a back perspective view of the lift 1 in an up position FIG. 2 is a back perspective view of the lift 1 of FIG. 1 in a down position. FIG. 3 is a side view of the lift 1 of the preceding figures in an up position attached to a transom (swim platform) 910 on the back of a larger boat 900. FIG. 4 is a side view of the lift 1 of FIG. 3 in a down position. FIG. 5 is a side view of the lift 1 in an up position attached to a dock 930. FIG. 6 is a side view of the lift 1 of FIG. 5 in a down position. FIG. 7 is a front view of the lift 1 of FIG. 1 along arrow F. FIG. 8 is a back view of the lift 1 of FIG. 1 along arrow B. FIG. 9 is a top view of the lift 1 of FIG. 1 along arrow T. FIG. 10 is a bottom view of the lift 1 of FIG. 1 along arrow U.

Referring to FIGS. 1, 2 and 7-10, the lift 1, generally includes a frame assembly 100, single main actuator 200 that raises and lowers lift arm assembly 300 that is in turn attached to a cradle 400 that has a rollable carriage 500 supported thereon.

Frame Assembly 100

Referring to FIGS. 1, 2 and 7-10, the lift 1 can include a frame assembly 100 having a generally rectangular configuration with a left bearing plate 110, right bearing plate 120, an L-shaped cross beam 140 connecting the bearing plates parallel to one another, and a protective nose shield 130 at a front end of the frame assembly 100. A rotatable crank shaft 150 can be inserted into through-holes of the bearing plates 110, 120 at a rear end of the frame assembly 100.

The ends of the crank shaft 150 are held in place to the bearing plates 110, 120 outer located left arm crank socket 170 and right arm crank socket 180. Bearings 151, 159 between crank sockets 170, 180 and bearing plates 110, 120 assist in allowing crank shaft 150 to be able to rotate in place.

Along a mid-portion of the crank shaft 150 can be an oblong shaped crank bracket 160 having an enlarged end 162 that is fixably attached about the mid-portion of the crank shaft 150. A downwardly protruding narrow end 168 of the crank bracket 160 can have a pivot point connection 169 that can be pivotally connected to one end 212 of the piston rod 210 of the main actuator 200.

Single Main Actuator 200

Referring to FIGS. 1, 2, and 7-10, the single main actuator 200 can be a single fluid cylinder and single piston that can be a hydraulic cylinder and piston. Alternatively, the single main actuator can be a pneumatic cylinder and piston. Main actuator 200 generally includes a piston 210 having a piston end 212 that is pivotally attached at a pivot point 169 to the narrow end 168 of crank bracket 160. The piston 210 can be fluid actuated to move in an out of a single cylinder 220. An other end of the cylinder 222 can be a rearwardly protruding portion 222 that is pivotally attached between parallel plates 230 that are fixably mounted under a mid-portion of L-shaped cross beam 140.

Lift Arm Assembly 300

Referring to FIGS. 1, 2, 7-10, the lift 1 can include a lift arm assembly 300 can include a left lift arm 310 having an end 312 inserted in and fixably attached to a U-shaped gusset portion 175 of left arm crank socket 170. A left extension member 320 can telescope relative to left lift arm 310 and be held to a selected extension length by a removable cotter type pin 315. The outer end 328 of left extension member 320 can bend upward in and be attached by swivel mount assembly 700 to cradle 400.

Additionally, the lift arm assembly 300 can include a right lift arm 330 having an end 332 inserted and fixably attached to a U-shaped gusset portion 185 of a right arm crank socket 180. A right extension member 340 can telescope relative to right lift arm 330 and be held to a selected extension length by another removable cotter type pin 335.

Figure 13:
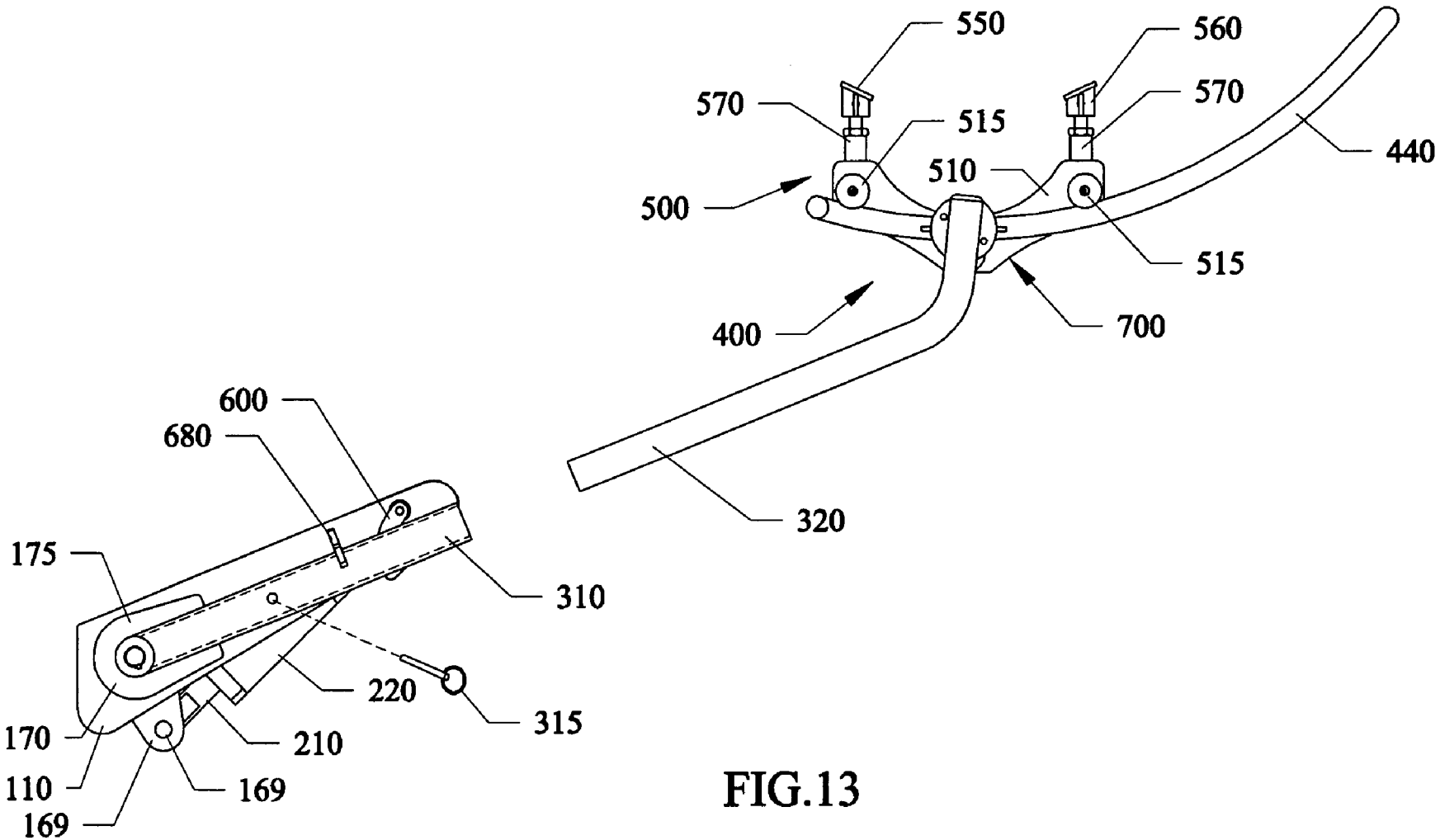
FIG. 13 is a side view of the arm with attached cradle detached from the lift frame.

FIG. 13 is a side view of the left extension member 320 with attached cradle 400 detached from the frame assembly 100, by removing the cotter type pin 315.

Cradle 400

Referring to FIGS. 1, 2, 7-10, the lift 1 can include a cradle 400 that can have a generally rectangular configuration formed from two end beams 410, 420 that are connected to one another by concave curved side beams 430, 440. A swivel mount 700 can fixably attach the cradle 400 at a fixed orientation relative the ends 328, 348 of the telescoping arm extension members 320, 340.

Carriage 500

Referring to FIGS. 1, 2, 7-10, the lift 1 can include a carriage 500 that rolls on the concave curved side beams 430, 440 of cradle 400. Carriage 500 can include matching left arc curved bracket 510, and right arc-curved bracket 520. Each of the brackets can include a triangular arrangement of three rollers 515, 525 mounted thereon. The rollers 515, 525 are arranged so that two can rest and ride on the upper surface of concave curved side beams 430, 440, while single rollers can rest and abut against a lower surface of the concave curved side beams 430, 440. Two parallel cross braces 530, 540 can connect the right and left arc-curved brackets to one another in a generally triangular arrangement.

Figure 11:
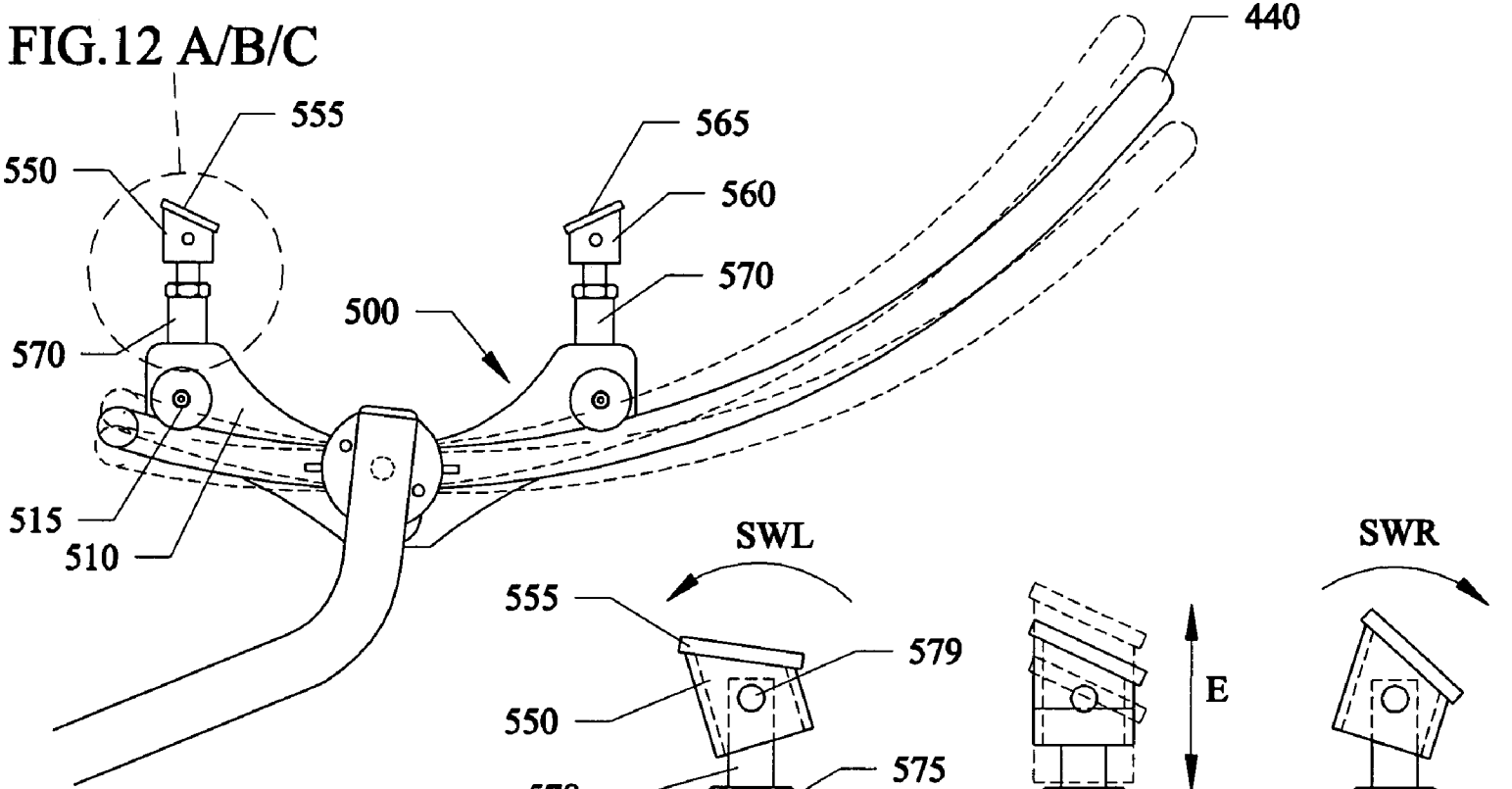
FIG. 11 is an enlarged view of the cradle and carriage of the lift.
Figure 12A:
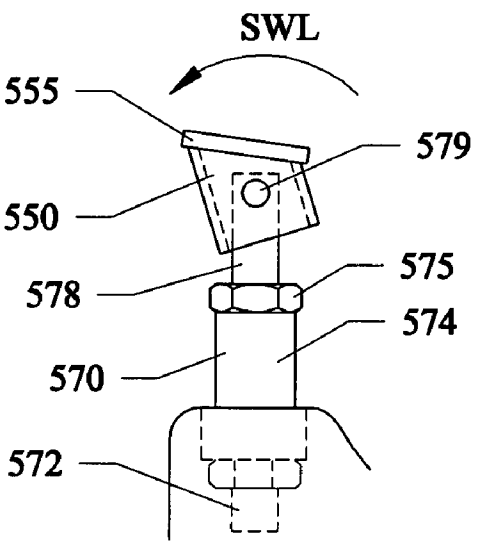
FIGS. 12A, 12B, 12C are enlarged views of the rail and swivel mounts pivoting to conform to different hull shapes of a cradle supported watercraft.
Figure 12B:
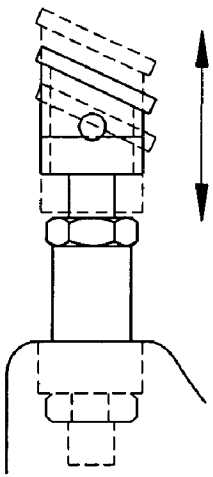
Figure 12C:
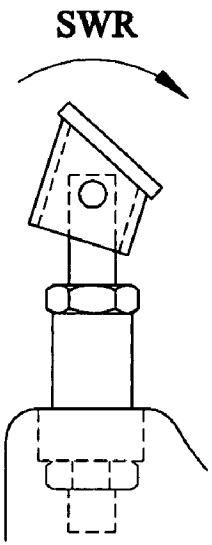

FIG. 11 is an enlarged view of the cradle 400 and carriage 500 of the lift 1. FIGS. 12A, 12B, 12C are enlarged views of the parallel watercraft support rails 550, 560 and swivel upright riser mounts 570 that pivot to conform to different hull shapes of a cradle supported watercraft 800.

Referring to FIGS. 1, 2, 7-12C, the arc-curved brackets 510, 520 can each include upright risers 570 that protrude upward from the ends of these brackets 510, 520. A total of approximately four identical upright risers 570 can be used, that each include a bottom end 572 that can be fastened by nuts and the like to the upwardly curved ends of the brackets 510, 520. A bottom cylinder portion 574 can have a nut that threadably locks an extension rod portion 578 thereon, so that the rises can be extended or retracted in the direction shown by arrow E. The extension rod portion 578 can have a pivot pin portion 579 that pivotally attaches the risers to the inside of downwardly facing open channel of the horizontal railings 550, 560. The upper surface of the horizontal rails 555, 565 can have pads that can be plastic, rubber, and the like, that can be used as a protective surface for the hull surface portions of the watercraft being carried thereon.

Figure 16:
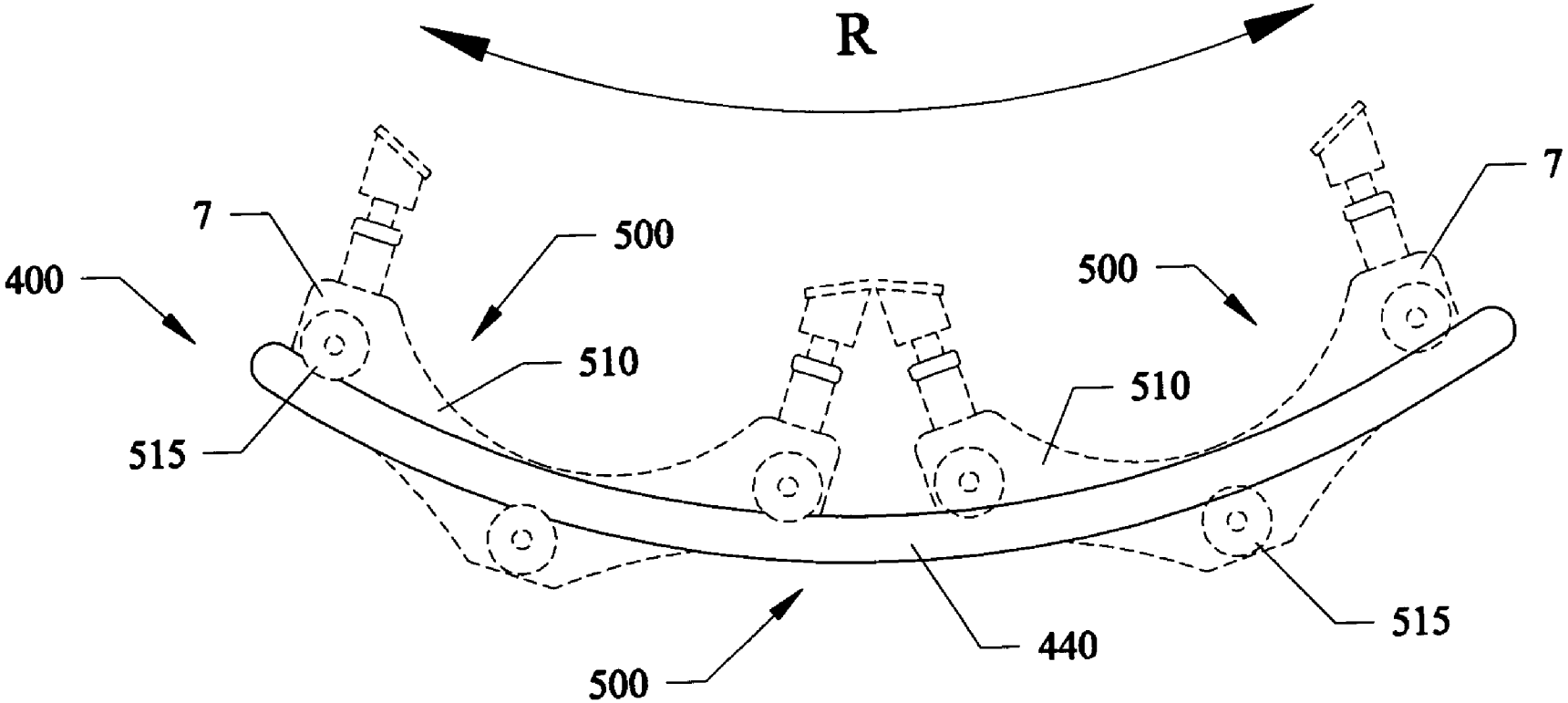
FIG. 16 is an enlarged side partial cut-away view of the carriage with rollers supported by the cradle.

FIG. 16 is an enlarged side partial cut-away view of the arc-curved bracket 510 of the carriage 500 with triangular arrangement of three rollers 515 that is attached to and rolls relative to the concave curved side beam 440 of the cradle 400.

Latch Assembly 600

Figure 17:
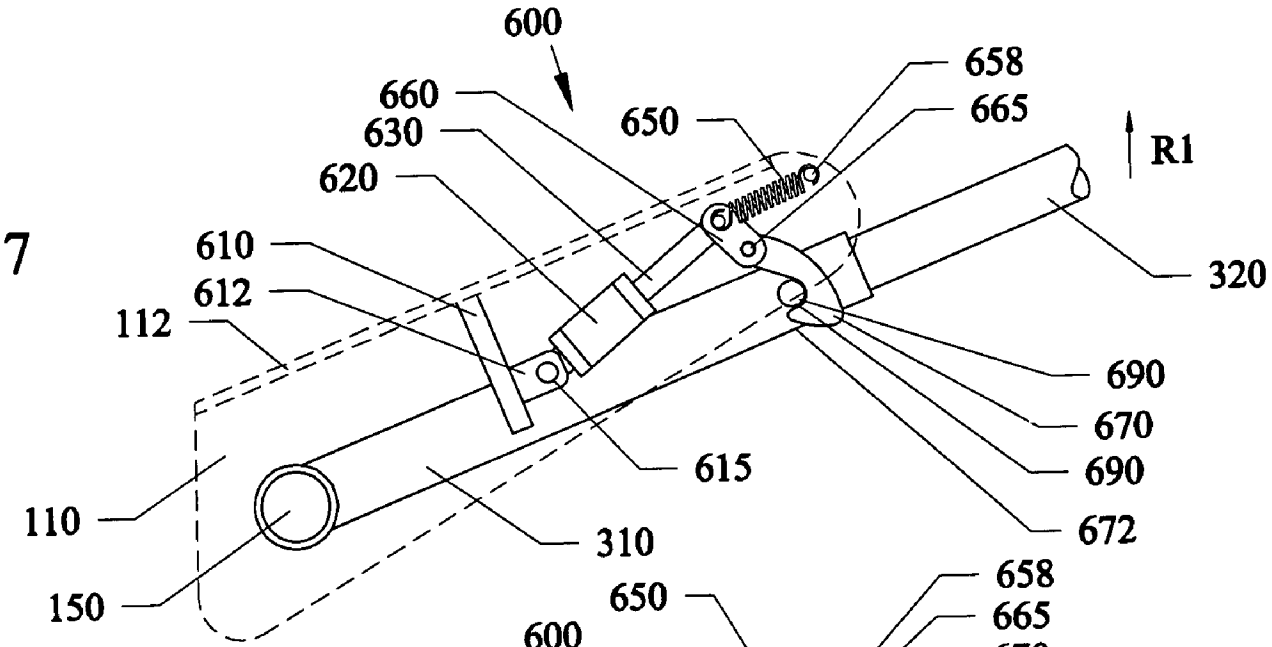
FIG. 17 is an enlarged side view of the cylinder operated latch holding the arm of the lift in a raised position.
Figure 18:
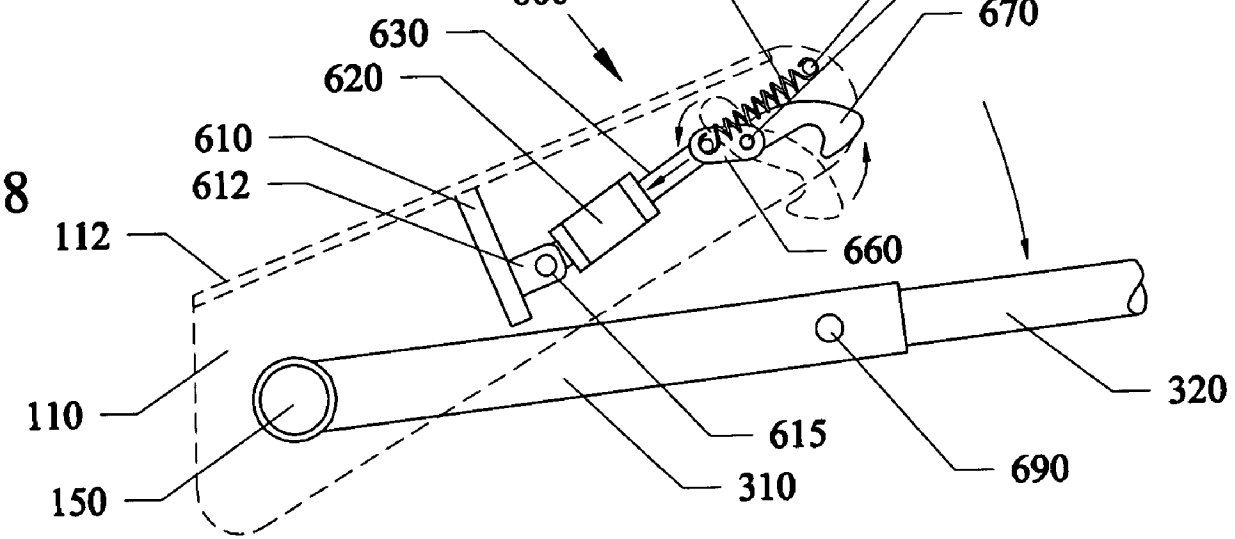
FIG. 18 is another view of FIG. 17 showing the latch in an open position and arm of the lift in a lowered position.

FIG. 17 is an enlarged side view of the cylinder operated latch assembly 600 holding the arm 310, 320 of the lift 1 in a raised position. FIG. 18 is another view of FIG. 17 showing the latch assembly 600 in an open position and arm 310, 320 of the lift in a lowered position.

Referring to FIGS. 1, 2, 13, 17, 18, the lift 1 can include a latch assembly 600 that allows the lifting arms 310/320, 330/340 to be locked as desired in a raised position. The left arm components 310/320 and the right arm components 330/340 can each include a latch assembly 600.

The latch assembly can include a support bracket 610 that downwardly protrudes from and is attached to flat plate portion 112 of bearing plate 110. A side protrusion portion 612 can extend sideways from the support bracket 610 and have a pivot pin connection to a rear end of a small fluid actuator 620 such as a small hydraulic cylinder, pneumatic cylinder and the like. A retractable piston 630 can extend from the opposite end of the cylinder 620 and have an end that is attached to both a latch spring 650 and an upwardly protruding end of an upper latch member 660, which has a lower end fixably attached to a lower latch member hook 670. The opposite end of the latch spring 650 can be fixably attached to a connector 658 on the side of bracket 110. The upper latch member and lower latch member hook 670 can be pivotally attached to the bracket 110 by a pivot pin connection 665.

Normally, the piston 630 of cylinder 620 can be pulled outward in an extended position by the bias of latch spring 650. As arm 310, 320 is being raised, a side protruding latch pin 690 on arm 310 can push against curved surface edge 672 of latch hook 670 so that the latch hook will result in hooking about the latch pin 690. A stopper member attached to the side of bracket 110 can limit the travel height of the lifting arms 310/320.

The operator can release the latch hook 670 by controlling cylinder 620 to retract piston 630, which results in upper latch member 660 and lower latch hook pivoting about pivot pin 665, which unhooks the latch hook 670 from about latch pin 690, and will allow arm 310, 320 to be lowered.

Controls for Main Actuator and Small Latch Actuator

Figure 19:
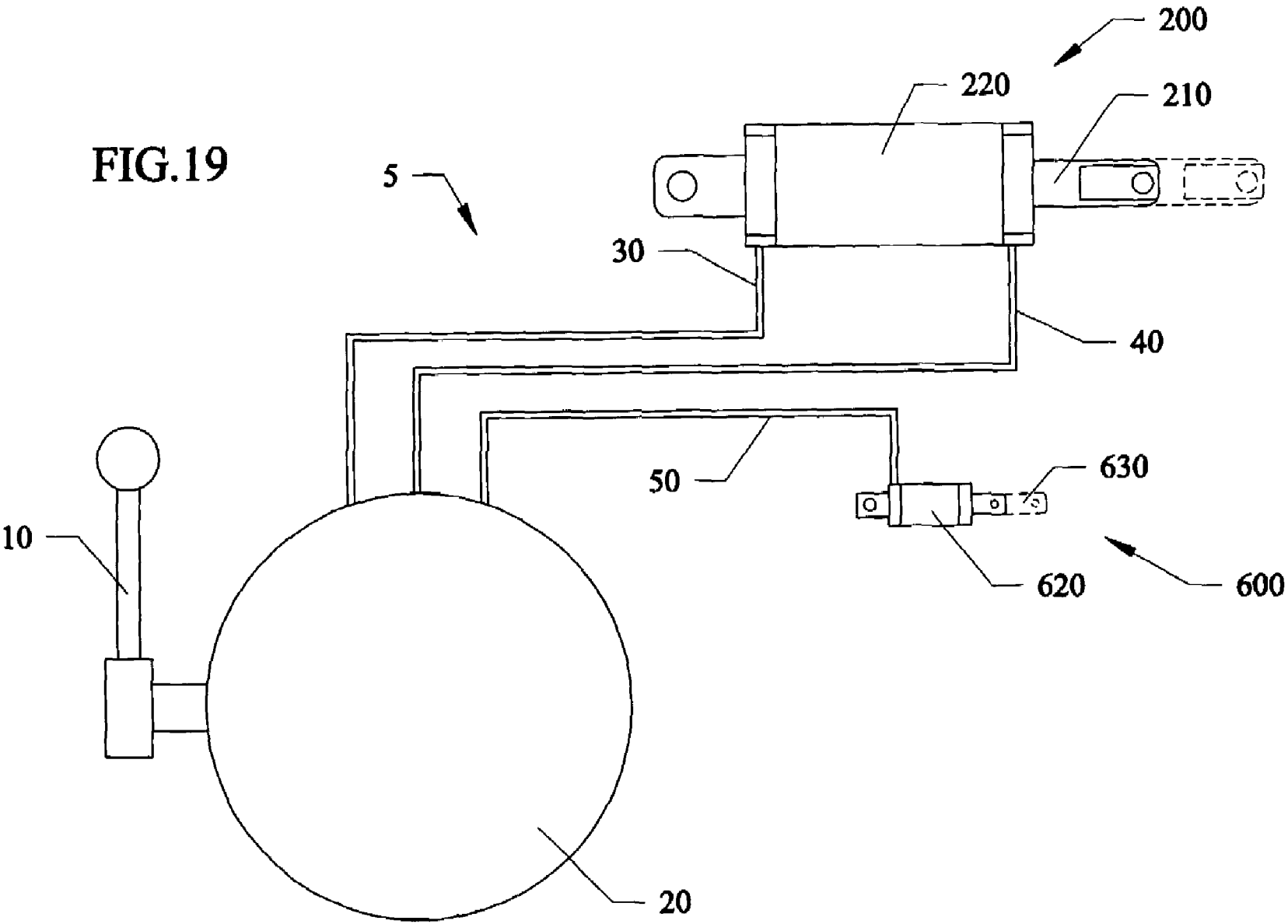
FIG. 19 is a schematic view of the controls for the single main fluid actuator for the lift arm and the fluid actuator for the latch of the preceding figures.

FIG. 19 is a schematic view of the controls 5 for the single main fluid actuator 200/210/220 for the lift arms 310/320, 330, 330 and the fluid actuator 620/640 for the latch assembly 600 of the preceding figures. A manual hand pump 10 can be connected to a power pack 20 such as a 12 volt/24 volt electro hydraulic power pack. Fluid actuation lines 30, 40, 50 can be used to actuate the pistons 210, 630 of the main actuator 200 and latch assembly cylinder 620. Conventional hydraulic controls such as that shown in U.S. Pat. No. 6,474,256 to Vogel, and U.S. Pat. No. 6,327,992 to Martin, which are both incorporated by reference can be used to control the actuators of the subject invention. The motors used to run the actuator(s) can include but not be limited to 120 volt power supply, battery power supply, solar power, and the like.

Swivel Mount Assembly 700

Figure 21:
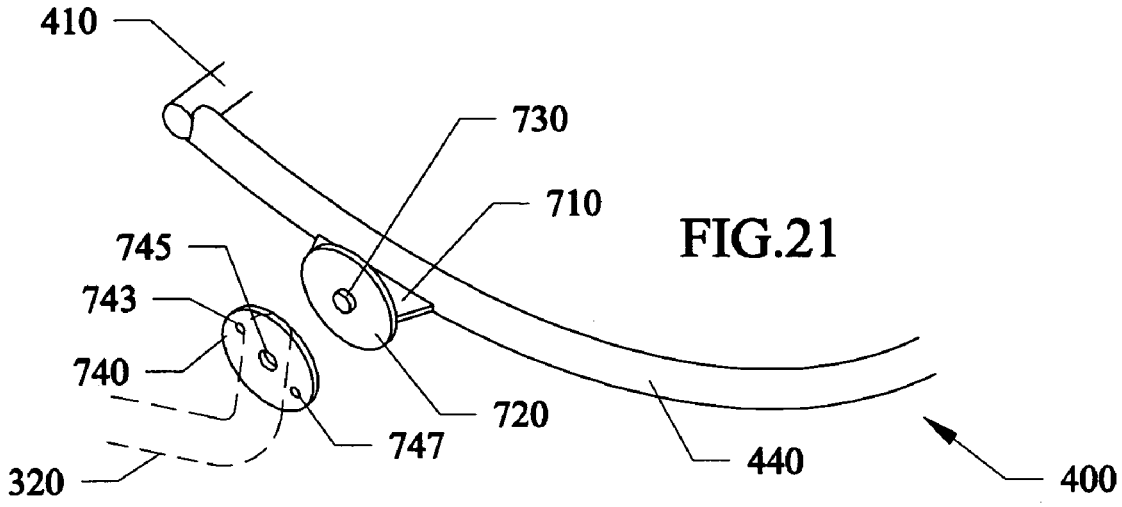
FIG. 21 is an enlarged view of the swivel mount separated from swivel plate for use with the cradle and arm.
Figure 22:
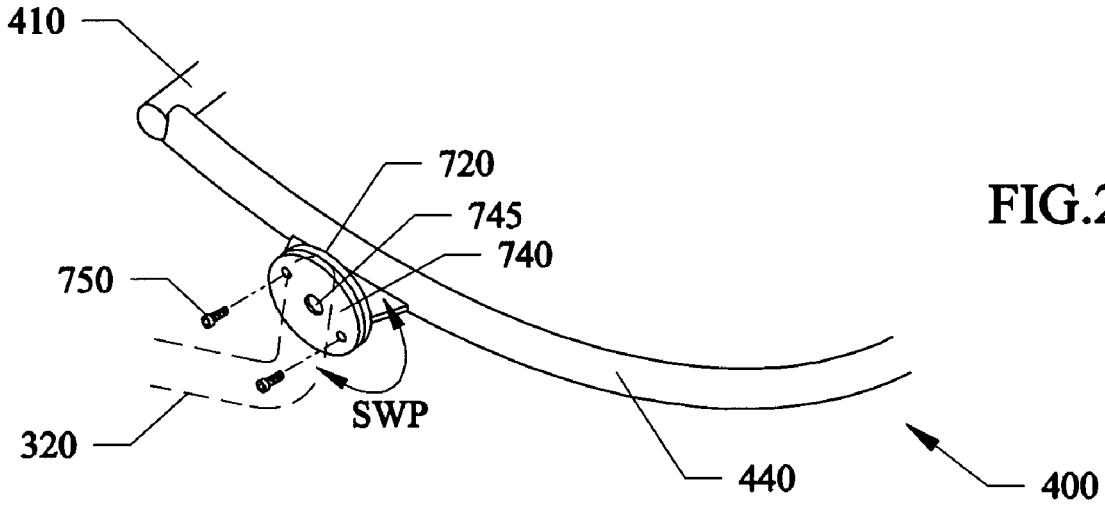
FIG. 22 is another view of FIG. 21 showing detached fasteners used for holding the arm in a fixed orientation position to the cradle.
Figure 23:
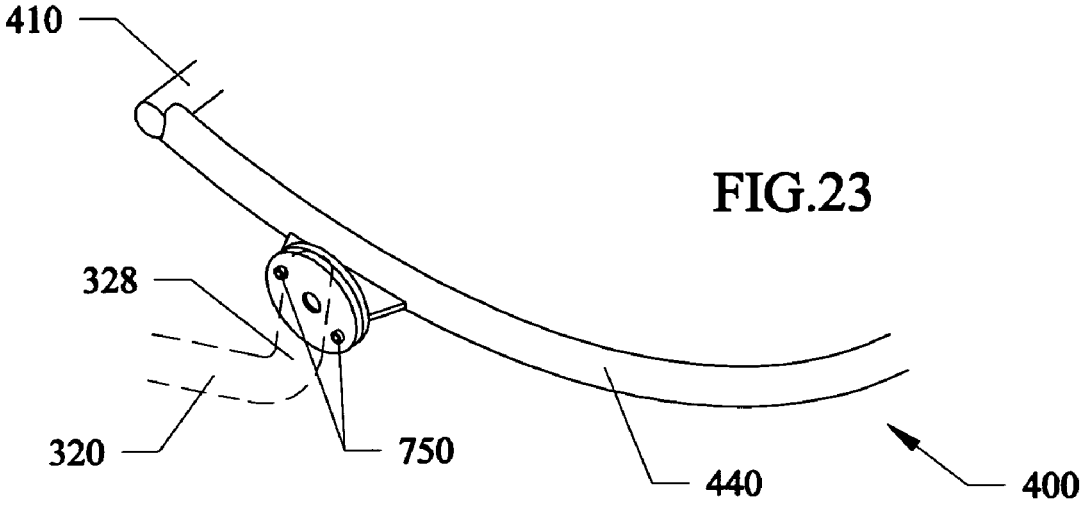
FIG. 23 is another view of FIG. 22 showing the fasteners attached to the swivel plate and mount holding the arm in the fixed orientation position to the cradle.

FIG. 21 is an enlarged view of the swivel mount 710 separated from swivel plate 740 for use with the cradle 400 and lifting arm 320. FIG. 22 is another view of FIG. 21 showing detached fasteners 750 such as bolts used for holding the arm 320 in a fixed orientation position to the cradle 400. FIG. 23 is another view of FIG. 22 showing the fasteners 750 attached to the swivel plate 740 and side plate 720 on the mount 710 holding the arm 320 in the fixed orientation position to the cradle 400. FIG. 24 is a top view of the swivel plate 740, side plate 720 on mount 710, cradle 400 and arm 320 of FIG. 23. FIG. 25 is a side view of FIG. 24 along arrow X1.

Referring to FIGS. 1, 2, 7-10 and 21-25, the swivel mount assembly 700, a mount 710 can be fixably attached to both concave curved side beams 440 (only one is shown for simplicity) of cradle 400. A side plate 720 with flat exterior side can be fixed to the mount 710. In the middle of the plate 720 can be an outwardly protruding cradle pivot pin 730. Next the center hole 745 of the lift arm swivel plate 740 can be positioned over the cradle pivot pin 730.

When first installing the lift 1, the user can orient the upper curved ends 328 (only one is shown for simplicity) of the arms 320, 340 so that when the arms 310/320 and 330/340 of the lift are in a raised position on both sides of a horizontal exterior brace beam 390, the user can position the outer ends of the beams against the outside of the swivel plate 740.

The user can orient the cradle between the outer ends of the arms 310/320, 330/340 until the cradle is in a substantially level position while the arms 310/320, 330/340 are in the raised position.

Next, the swivel plate 740 can be twisted clockwise or counter-clockwise in the direction of arrow SWP so that the side holes 743, 747 are positioned directly adjacent to side edges on opposite sides of the upper end 328 of the arm 320.

When the level orientation position of the cradle is reached, the user can drill through the existing side holes 743, 747 into plate 720 and then attach bolts through holes 743, 747, where the heads of the bolts 750 effectively lock the orientation of the cradle relative to the lift arms 310/320, 330/340.

Operation

A preferred application of the invention is using the novel lift with a larger vessel for raising and lowering smaller watercrafts therefrom. FIG. 14 is a side partial cut-away view of the lift 1 showing the fluid actuator 200 holding the arm 310/320 and cradle 400 in a raised position. FIG. 15 is another side partial cut-away view of the lift 1 of FIG. 14 with arm 310/320 and cradle 400 in lowered position.

Referring to FIGS. 1-4, 14 and 15 top flat plate portions 112, 122 of the bearing plates 110, 120 can be used to flush mount the frame assembly 100 by fasteners such as conventional bolts (not shown) underneath an angled bottom of a boat transom (swim platform 910) that is attached to a larger vessel 900. In the raised position a small personal watercraft 800 such as but not limited to a jet ski or inflatable can be supported by the hull conforming pivotable rails 550, 560, on the carriage 500 in a substantially level position.

To lower the carriage 500 and cradle 400, a single piston 210 from main cylinder 220 can move from a retracted position to an extended position and move narrow end 168 of crank bracket 160 at pivot point 169. The enlarged end 162 of the crank bracket being fixably attached to crank shaft 150 effectively rotates the crank shaft 150 in a clockwise direction. Since the bottom ends of arms 310, 330 are fixably attached to crank sockets 170, 180 which are in turn fixably attached to ends of the crank shaft 150, the lift arms 310/320, 330, 340 move downward lowering cradle 400. As the cradle 400 is lowered into the water, the carriage 500 can roll off the curved side beams 430, 440 of the carriage by gravity and effectively allow the watercraft 800 to slip easily and safely into the water.

Retracting the piston 210 into actuator cylinder 220 reverses the operation allowing the cradle 400 to rise upward. An optional stopper-bumper on the cradle 400 can prevent the carriage 500 from fully rolling off of the cradle.

Another application of the novel lift is attaching the frame assembly portion underneath a horizontal surface. FIG. 5 is a side view of the lift 1 in an up position attached to a dock 930. FIG. 6 is a side view of the lift 1 of FIG. 5 in a down position. The ends 320/340 of the arms can be bent to allow the cradle to support the watercraft 800 in substantially level positions. The operation is similar to that previously described.

Figure 20:
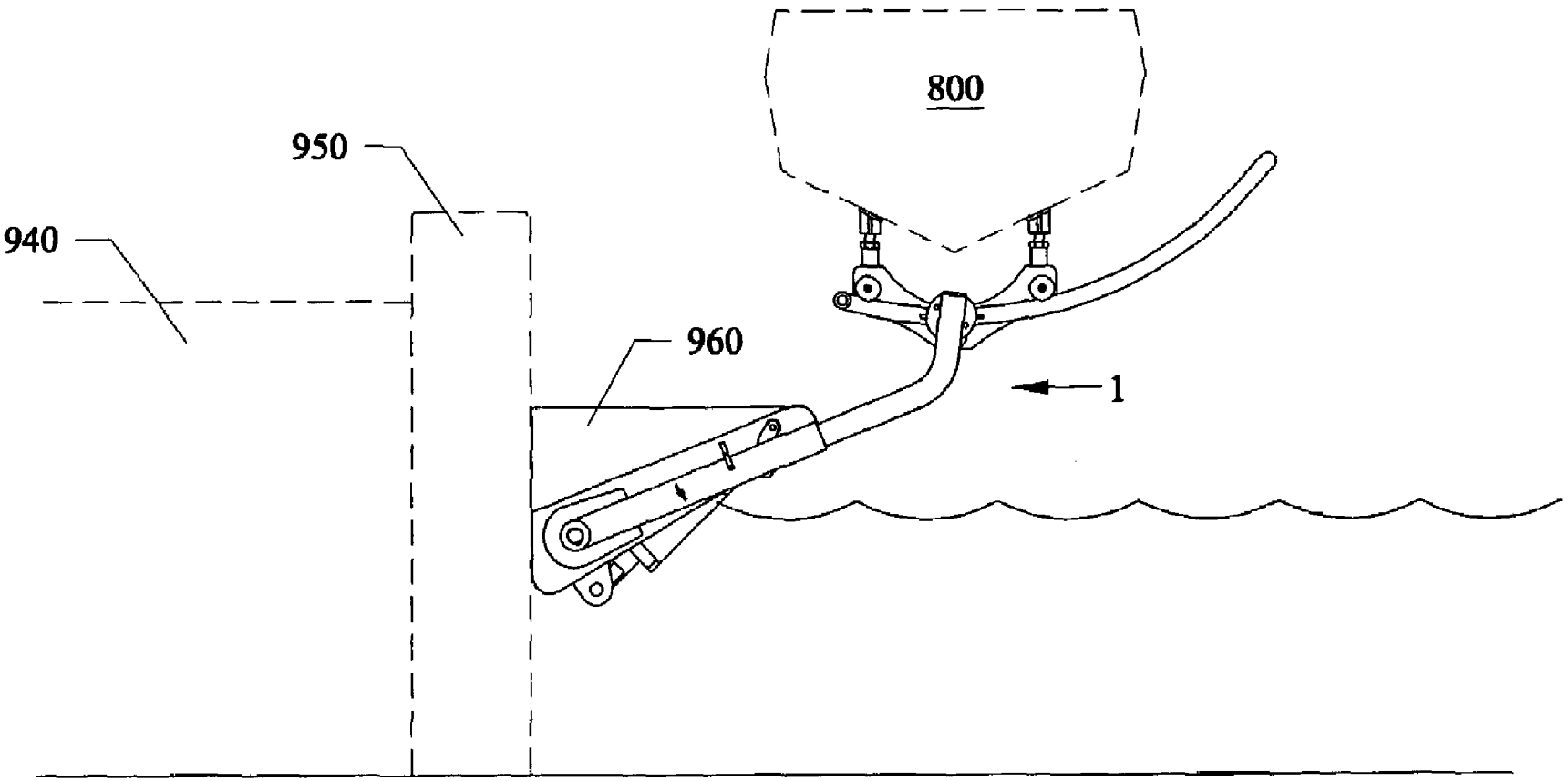
FIG. 20 is a side view of the lift in an up position attached to a side of a bulkhead.

Another application of the novel lift is attaching the frame to a wall by using an adapter such as a triangular adapter type bracket 960. FIG. 20 is a side view of the lift 1 of the preceding figures in an up position attached to a side wall 950 of a bulkhead 940. The operation of the lift can also be similar to that previously described.

The components used to make the lift can include but are not limited to stainless steel, galvanized steel, plastics, composites, combinations thereof, and the like.

The main actuator for the raising and lowering the arm(s), and the latch actuator, can be a fluid actuator such as but not limited to hydraulic, pneumatic, seawater, city water pressure supplies, and the like.

The lift can lift personal watercrafts having weights of up to approximately 800 to approximately 1,500 pounds or more. Using different sized components such as the actuators and the arm(s) can be used to lift larger craft such as but not limited to actual pleasure boats, manned submersibles, unmanned submersibles, that can weigh up to several tons or more.

Although the invention has been described as having a separate crank bracket for the main actuator and separate crank sockets for the arms, the invention can use a single bracket that is connected to both the actuator and the arms and to the crank shaft. For example, an L-shaped bracket where the angled corner of the L is fixed to the shaft and the outer legs of the L are each attached to the actuator and to control the raising and lowering of one or more arm(s) can be used. The actuator can be used to rotate the shaft component which can then raise and lower the arm or arms.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A lifting device for raising and lowering water crafts, comprising:

a frame attached to a support;

a rotatable crank member attached to the frame;

a fluid operated actuator having one end attached to the frame and an another end attached to the crank member;

an arm having a first end attached to the crank member and a second end; and a cradle supporting a watercraft which is attached to the second end of the arm, wherein the fluid actuator lowers and raises the cradle with the supported watercraft;

a carriage;

at least one upper roller attached to the carriage, the upper roller for riding on an upper surface of the cradle; and at least one lower roller attached to the carriage, the lower roller for riding against a lower surface of the cradle, the upper and the lower rollers allowing the carriage to roll relative to the cradle and allow the carriage to support a watercraft thereon in a substantial level position while the arm and the attached cradle are being raised and lowered by the arm.

2. The lifting device of claim 1, wherein the rotatable crank includes:

a rotatable crank shaft with a crank bracket fixably attached to the rotatable crank shaft, the one end of the fluid operated actuator pivotably attached to the crank bracket and the first end of the arm fixably attached to the rotatable crank shaft.

3. The lifting device of claim 1, wherein the arm includes:

a telescoping section that allows the arm to have a varying length.

4. The lifting device of claim 1, wherein the fluid actuator includes:

a single hydraulic cylinder and single actuated piston for raising and lowering the arm and the attached cradle.

5. The lifting device of claim 1, wherein the fluid actuator includes:

a single pneumatic cylinder with single actuated piston.

6. The lifting device of claim 1, wherein the cradle includes:

a concave curved surface on the cradle, wherein the carriage is positioned on the concave curved surface of the cradle, the carriage allowing the watercraft to remain in a substantial level position while the arm and the attached cradle are being raised and lowered.

7. The lifting device of claim 1, wherein the rollers include:

a first set of three rollers arranged in a triangular pattern on one side of the carriage; and a second set of three rollers arranged in a triangular pattern on another side of the carriage, the first and second sets of rollers allowing the carriage to roll relative to the cradle.

8. The lifting device of claim 1, the carriage further comprising:

upright supports pivotally attached to the carriage, the pivotal upright supports allowing the water craft to be firmly supported in a stable position to the carriage.

9. The lifting device of claim 1, further comprising:

a swivel mount for locking the cradle to the arm.

10. The lifting device of claim 1, further comprising:

a swivel mount for locking the cradle to the arm, wherein the swivel mount includes a swivel plate having a fastener for holding the arm in a selected fixed orientation position relative to the cradle.

11. The lifting device of claim 10, wherein the fastener includes:

a first fastener along one side of the arm; and a second fastener along another side of the arm, wherein the first and the second fasteners lock the cradle in the selected fixed orientation position relative to the cradle.

12. The lifting device of claim 1, further comprising:

a latch for holding the arm in the raised position.

13. The lifting device of claim 12, further comprising:

another fluid operated actuator for opening and closing the latch.

14. The lifting device of claim 1, wherein the support includes:

a transom on a large watercraft.

15. The lifting device of claim 1, wherein the support includes: a dock.

16. The lifting device of claim 1, wherein the support includes: a bulkhead.

17. The lifting device of claim 1, wherein the watercraft includes: a jet ski.

18. The lifting device of claim 1, wherein the watercraft includes: an inflatable.

19. A lifting device for raising and lowering water crafts, comprising:

a frame attached to a support;

a rotatable member attached to the frame;

fluid operated actuator attached to the frame and the rotatable member;

an arm having a first end attached to the rotatable member and a second end, the fluid operated actuator for rotating the second end of the arm relative to the frame;

a cradle with curved surface attached to the second end of the arm;

a self leveling carriage positioned on the curved surface of the cradle;

a first set of three rollers arranged in a triangular pattern on the carriage;

a second set of three rollers arranged in a triangular pattern on the carriage, the first and second sets of rollers allowing the carriage to roll relative to the cradle and allow the carriage to support a watercraft thereon in a substantial level position while the arm and the attached cradle are being raised and lowered by the actuator.

20. A lifting device for raising and lowering water crafts, comprising:

a fluid actuated rotatable arm having a first end attached to a support and a second end; and a cradle supporting a watercraft, the cradle is attached to the second end of the arm, wherein the fluid actuated rotatable arm lowers and raises the cradle with the supported watercraft;

a carriage;

at least one upper roller attached to the carriage, the upper roller for riding on an upper surface of the cradle; and at least one lower roller attached to the carriage, the lower roller for riding against a lower surface of the cradle, the upper and the lower rollers allowing the carriage to roll relative to the cradle and allow the carriage to support a watercraft thereon in a substantial level position while the arm and the attached cradle are being raised and lowered by the arm.

21. The device of claim 20, wherein the cradle includes:

an upper concave curved surface; and a lower convex curved surface.

* * * * *